US009028030B2

(12) United States Patent
Takekoshi et al.

(10) Patent No.: US 9,028,030 B2
(45) Date of Patent: May 12, 2015

(54) PRINTING APPARATUS, PRINTING METHOD, IMAGE PROCESSING APPARATUS, STORAGE MEDIUM, AND PRINT CONTROL APPARATUS

(71) Applicant: Canon Kabushiki Kaisha, Tokyo (JP)

(72) Inventors: Rie Takekoshi, Kawasaki (JP); Takumi Kaneko, Tokyo (JP); Yumi Kamimura, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/318,297

(22) Filed: Jun. 27, 2014

(65) Prior Publication Data

US 2015/0002570 A1 Jan. 1, 2015

(30) Foreign Application Priority Data

Jun. 28, 2013 (JP) ..... 2013-136148

(51) Int. Cl.
*B41J 2/205* (2006.01)
*B41J 2/21* (2006.01)

(52) U.S. Cl.
CPC ..... *B41J 2/2103* (2013.01)

(58) Field of Classification Search
CPC ..... B41J 2/2107; B41J 2/2132; B41J 2/2052; B41J 9/147; C09D 11/322; C09D 11/40
USPC ..... 347/9–12, 14–15, 37, 40–43, 54, 56–57
See application file for complete search history.

(56) References Cited

U.S. PATENT DOCUMENTS

| | | | | |
|---|---|---|---|---|
| 6,827,424 | B2 * | 12/2004 | Teshigawara et al. | 347/43 |
| 8,783,808 | B2 * | 7/2014 | Takekoshi et al. | 347/14 |
| 2007/0109604 | A1 | 5/2007 | Marumoto | |

* cited by examiner

*Primary Examiner* — Thinh Nguyen
(74) *Attorney, Agent, or Firm* — Canon U.S.A., Inc. IP Division

(57) ABSTRACT

When the contact angle of a first color ink on a layer of a second color ink is larger than the contact angle of the second color ink on a layer of the first color ink, ejection of the first and the second color ink is controlled so that the number of pixel areas onto which the second color ink is applied after the first color ink is larger than the number of pixel areas onto which the first color ink is applied after the second color ink.

24 Claims, 17 Drawing Sheets

FIG. 15

| INK LAYER | INK DROPLET | CONTACT ANGLE (DEGREE) | DOT DIAMETER (μm) | VISUAL GRAININESS |
|---|---|---|---|---|
| MAGENTA INK | YELLOW INK | 27 | 50 | GOOD |
| YELLOW INK | MAGENTA INK | 36 | 44 | BAD |
| CYAN INK | YELLOW INK | 27 | 51 | GOOD |
| YELLOW INK | CYAN INK | 35 | 41 | BAD |
| BLACK INK | MAGENTA INK | 37 | 47 | GOOD |
| MAGENTA INK | BLACK INK | 43 | 44 | BAD |
| BLACK INK | YELLOW INK | 32 | 48 | GOOD |
| YELLOW INK | BLACK INK | 37 | 44 | BAD |
| BLACK INK | CYAN INK | 32 | 47 | RATHER GOOD |
| CYAN INK | BLACK INK | 31 | 48 | RATHER BAD |
| CYAN INK | MAGENTA INK | 31 | 45 | EQUAL |
| MAGENTA INK | CYAN INK | 32 | 45 | EQUAL |

PRINTING APPARATUS, PRINTING METHOD, IMAGE PROCESSING APPARATUS, STORAGE MEDIUM, AND PRINT CONTROL APPARATUS

BACKGROUND

1. Field

The present application relates to a printing apparatus, a printing method, an image processing apparatus, a storage medium, and a print control apparatus.

2. Description of Related Art

Printing apparatuses have been known which form an image on a printing medium by repeating a sequence of scanning operation for printing (hereinafter referred to as print scanning operation) and sub-scanning operation for conveying the printing medium. For the print scanning operation, a printing head ejects ink through a plurality of ejection openings arranged therein while scanning the printing medium. The print scanning operation of such a printing apparatus is generally performed by a multipass method in which a plurality of print scanning operations are performed on a unit region of a printing medium.

It has been known that printing apparatuses of this type have a problem of beading, which is a phenomenon of ink droplets connected by ejecting ink droplets close to each other on a printing medium in print scanning operation. Beading may lead to a nonuniform image and degraded image quality. In order to reduce the occurrence of beading, US 2007/0109604 discloses that ink droplets are applied in a dispersed manner to a printing medium to avoid beading of landed ink droplets in a stage of image formation. This technique is achieved by using mask patterns including printable pixels in an arrangement calculated for reducing the repulsive potential between the printable pixels.

In recent years, ink jet printing has been increasingly used to produce printed mutter for various applications, and various types of ink and printing media have been being used accordingly. For forming highly bright images, a combination of an ink and a printing medium has been known. In this combination, an ink containing a pigment is fixed to the surface of a printing medium less permeable to the ink (hereinafter referred to as less permeable printing medium).

The present inventors have however found that printing operation using an ink containing a pigment and a less permeable printing medium may cause marked beading and thus fail to provide satisfactory image quality. In addition, the present inventors have found the reason of this disadvantage. More specifically, the reason is that when such an ink is fixed to the surface of a less permeable printing medium, the ink is kept in a liquid state on the printing medium for a longer time than the conventional case where ink is fixed to a printing medium by permeation of the ink.

This disadvantage will now be described in detail. FIG. 1 schematically shows a droplet 51 of a first ink containing a pigment on a layer 50 of a second ink containing a pigment, formed by ejecting the second and the first ink in that order onto the same region on a less permeable printing medium 3, in section taken along a plane perpendicular to the surface of the printing medium 3.

When an ink containing a pigment and a less permeable printing medium are used for printing, ink droplets are fixed to the surface of the printing medium without permeating into the printing medium, thus forming an ink layer to cover the surface of the printing medium, as shown in FIG. 1. When another ink is additionally ejected to a region where an ink has been applied, therefore, the ink ejected later is applied to a layer made of the previously ejected ink, but not on the surface of the printing medium.

In the following description, the first and the second ink have substantially the same surface tension in liquid phase, but the wettability of the second ink on a layer made of the first ink is higher than the wettability of the first ink on a layer made of the second ink. Wettability is an index of how easily a droplet spreads over a solid surface and wets it. The wettability of a liquid can be estimated by the contact angle of the liquid, which is the angle between a solid surface and the tangent to a droplet of the liquid at the contact point with the solid surface. As a droplet spreads more easily over a solid surface and wets it, the contact angle decreases.

The contact angle of an ink varies depending on the surface tension $\gamma_L$ of the ink in liquid phase and the critical surface tension of a solid surface to which the ink is applied. Critical surface tension is one of the indices of the surface tension of a solid. As the surface tension $\gamma_L$ of an ink in liquid phase increases, or as the critical surface tension of a solid surface to which the ink is applied decreases, the contact angle of the ink increases. The surface tension $\gamma_L$ of an ink depends on the chemical properties of the ink, and the critical surface tension of a solid surface depends on the chemical properties of the solid surface, for example, an ink layer.

Even though the surface tensions $\gamma_L$ in liquid phase of two inks are the same, the ink layers made of each of the inks on a printing medium have different critical surface tensions. In the present embodiment, the critical surface tension of the layer of the first ink on a printing medium is larger than the critical surface tension of the layer of the second ink on the printing medium.

When the second ink and the first ink are applied in that order to a printing medium, as shown in FIG. 1, the first ink is applied to an ink layer of the second ink having a lower critical surface tension, and the contact angle of the first ink is relatively large. Consequently, force F acting on the ink droplet in a direction parallel to the surface of the printing medium, or in the direction in which the ink droplet spreads over the surface and wet it, decreases.

FIG. 2 shows the surface of a printing medium onto which a plurality of droplets of the second ink and the first ink have been ejected in that order as in the case of FIG. 1, wherein the droplets of each ink are applied close to each other by the same print scanning operation.

When the first ink, applied after the second ink, has come in contact with the ink layer 50 of the second ink, as shown in FIG. 2, force F acting on the ink droplets in the direction in which the droplets spread over the surface and wets it is small, and accordingly, the droplets tend strongly to aggregate together. This causes marked beading, and consequently, the final image formed on the printing medium exhibits markedly increased graininess.

Furthermore, the ink droplets 51 cover only a small area of the ink layer 50. Accordingly, the final image is undesirably defined by a mixture of an area whose uppermost layer is made of the ink droplets 51 and an area whose uppermost layer is made of the ink layer 50. Thus, the uniformity of the resulting image is also degraded.

In particular, if an ink containing a fluorocarbon surfactant is first applied, the fluorocarbon surfactant reduces the critical surface tension of the layer of this ink, thus causing marked beading.

Therefore, if an ink having a relatively low wettability to an ink layer is fixed to the ink layer, the quality of the resulting image in, for example, graininess and uniformity is likely to be degraded. Such degradation resulting from beading becomes particularly significant when an image with a tone level from halftone to high tone is printed, that is, when ink droplets are applied close to each other at high density in one print scanning operation.

SUMMARY

The present application provides a printing apparatus and a printing method that can reduce degradation in image quality resulting from beading of ink droplets.

Accordingly, an embodiment of the present application provides a printing apparatus including a printing head capable of ejecting a first color ink containing a pigment and a second color ink containing a pigment and having a color different from the first ink, a scanning unit configured to cause the printing head to scan a unit region of a printing medium in a scanning direction, and a controller configured to control the printing head so as to eject the first and the second color ink onto a plurality of pixel areas, equivalent to pixels, arranged in the unit region while the scanning unit cause the printing head to scan. In this instance, the first color ink has a contact angle on a layer made of the second color ink larger than the contact angle of the second color ink on a layer made of the first color ink, and the controller controls ejection of the first and the second color ink so that the number of pixel areas in the unit region onto which the second color ink is applied after the first color ink is larger than the number of pixel areas in the unit region onto which the first color ink is applied after the second color ink.

Further features of the present invention will become apparent from the following description of exemplary embodiments with reference to the attached drawings.

BRIEF DESCRIPTION OF THE DRAWINGS

FIG. 15 is a table showing the relationship between the contact angles of a plurality of inks used in an embodiment and the graininess of images formed of the inks.

DETAILED DESCRIPTION

First Embodiment

A first embodiment will now be described with reference to some of the drawings.

Figure 1:
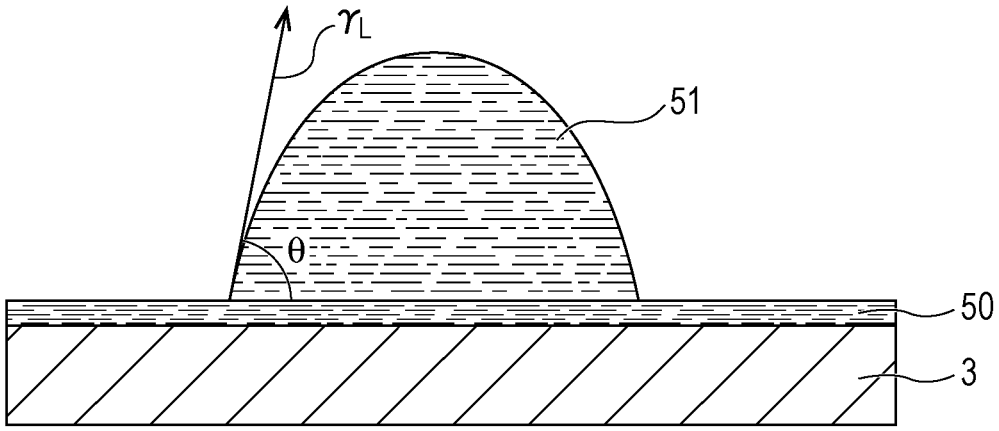
FIG. 1 is a representation illustrating a relationship between wettability and contact angle.
Figure 2:
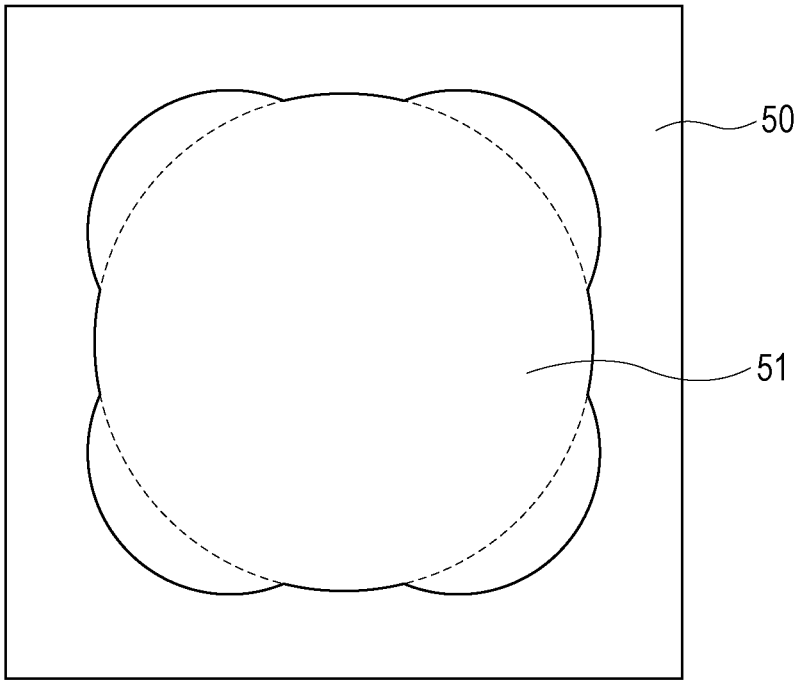
FIG. 2 is a representation illustrating the relationship between wettability and beading.
Figure 3:
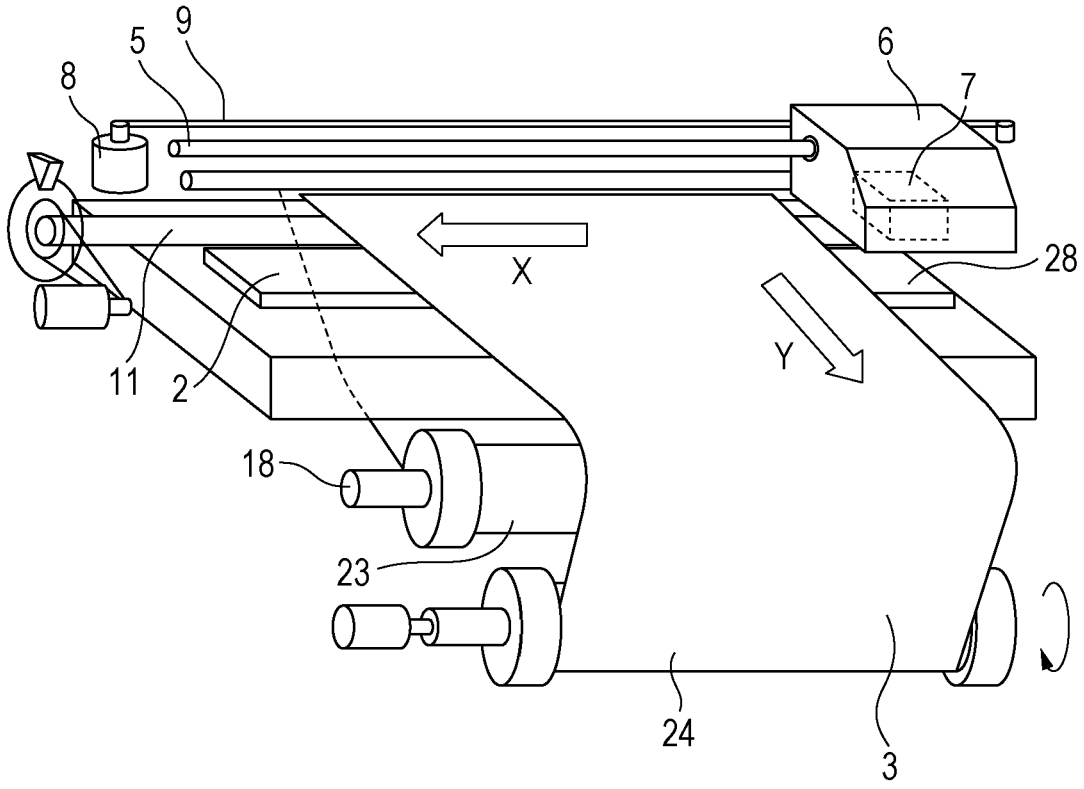
FIG. 3 is a perspective view of a printing apparatus according to an embodiment.
Figure 4:
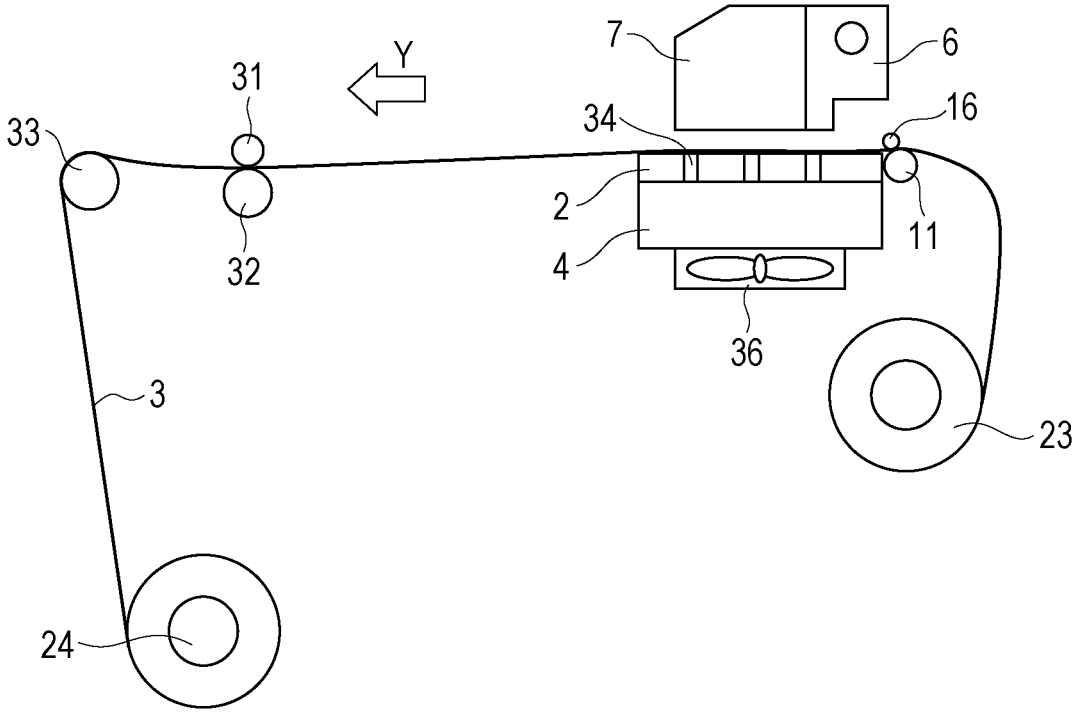
FIG. 4 is a side view of the printing apparatus.

FIG. 3 is a fragmentary perspective view illustrating the internal structure of a printing apparatus according to the first embodiment. FIG. 4 is a fragmentary side view of the internal structure of the printing apparatus.

The printing apparatus includes a platen 2 therein. The platen 2 has suction holes 34 that suck a printing medium 3 to keep the medium from floating. The suction holes 34 communicate with a duct. The printing medium 3 is sucked to the platen 2 by the operation of a suction fan 36 disposed under the duct.

A carriage 6 is held for reciprocal movement in directions parallel to the X direction by a main rail 5 extending along the width of the printing medium. The carriage 6 contains an ink jet printing head 7, which will be described later. The printing technique applied to the printing head 7 may be selected various techniques, such as a thermal jet technique using a heating element and a piezoelectric technique using piezoelectric elements. A carriage motor 8 is a driving source for moving the carriage 6 in the X direction, and the rotational driving force of the carriage motor 8 is transmitted to the carriage 6 with a belt 9.

The printing medium 3 is a part of a rolled medium 23, fed therefrom. The printing medium 3 is conveyed on the platen 2 in the Y direction (conveying direction) intersecting the X direction (scanning direction). The printing medium 3 is pinched at an end thereof between a pitch roller 16 and a conveying roller 11. The rotation of the conveying roller 11 enables the printing medium 3 to be conveyed. The printing medium 3 is also pinched at a position downstream of the Y direction from the platen 2 between a roller 31 and a sheet ejection roller 32 and is further wound on a take-up roller 24 via a turning roller 33.

Figure 5:
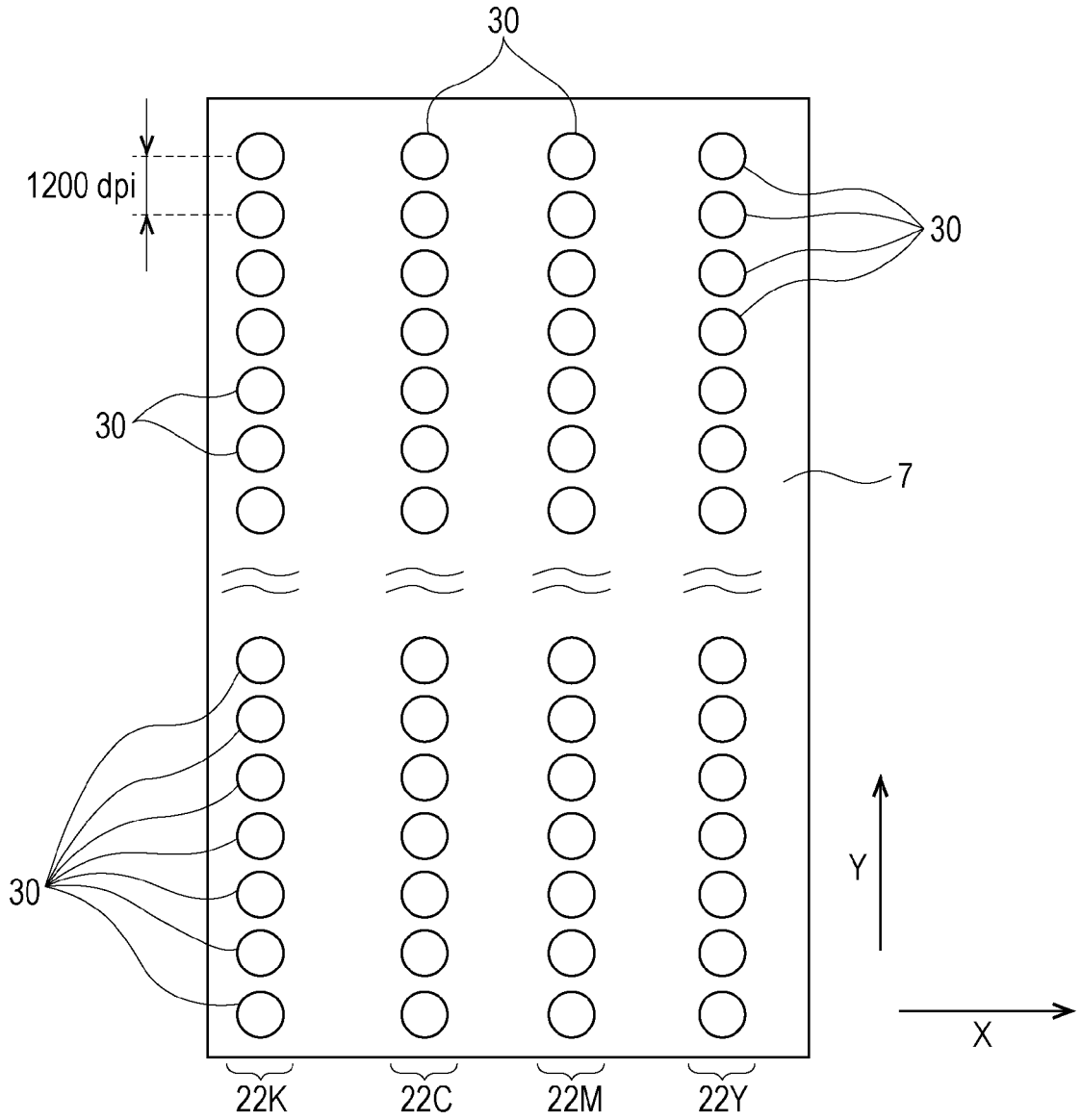
FIG. 5 is a schematic view of a printing head used in an embodiment of the invention.

FIG. 5 shows the printing head used in the present embodiment. The printing head 7 has four ejection opening lines 22K, 22C, 22M and 22Y arranged in parallel in the X direction. Inks of black (K), cyan C), magenta (M) and yellow (Y) are ejected through ejection openings 30 in the lines 22K, 22C, 22M and 22Y, respectively. Each of the ejection opening lines 22K, 22C, 22M and 22Y has 1280 ejection openings 30 aligned in the Y direction with a density of 1200 dpi. In the present embodiment, the amount of ink ejected at one time through one ejection opening 30 is about 4.5 ng.

Each of the ejection opening lines 22K, 22C, 22M and 22Y communicates with a corresponding ink tank (not shown) that stores the corresponding ink, and the ink is fed from the ink tank. The printing head 7 and the ink tank may be integrated into one body or may be separable.

The inks used in the present embodiment will now be described in detail. Each of the inks used in the present embodiment contains a fluorocarbon surfactant so as to stably disperse the coloring material in the ink and increase the wettability of the ink to printing media. The fluorocarbon surfactant used in the present embodiment is a compound having a perfluoroalkyl group. Fluorocarbon surfactants that can be used in the present embodiment include perfluoroalkylsulfonates, perfluoroalkylcarboxylates, perfluoroalkylphosphoric acid esters, perfluoroalkylethylene oxide adducts, perfluoroalkylbetaines, and perfluoroalkylamine oxide compounds. Commercially available fluorocarbon surfactants may be used such as Surflon series S-111, S-112, S-113, S-121, S-131, S-132, S-141 and S-145 (produced by Asahi Glass), and Fluorad FC-93 (produced by 3M). Also, other fluorocarbon surfactants may be used in the present embodiment, such as Fluorad series FC-95, FC-98, FC-129, FC-135, FC-170C, FC-430, FC-431 and FC-4430 (each produced by 3M), and Megafac series F-470, F-1405 and F474 (produced by produced by DIC). Furthermore, Zonyl series FS-300, FSN, FSN-100 and FSO (produced by Du Pont), and Eftop series EF-351, EF-352, EF-801 and EF-802 (produced by JEMCO) may be used. Zonyl series FS-300, FSN and FSO-100 (produced by Du Pont) are advantageous in terms of, particularly, reliability and color developability. These surfactants may be used singly or in combination. In the present embodiment, FSO-100 (produced by Du Pont) is used as a fluorocarbon surfactant for each ink.

A process for preparing the inks will be described below. In the following description, "part(s)" and "%" are on a mass basis unless otherwise specified.

Preparation of Black Ink

First, an anionic polymer P-1 [styrene/butyl acrylate/acrylic acid copolymer (polymerization ratio: 30/40/30, acid value: 202, weight average molecular weight: 6500)] is neutralized with an aqueous solution of potassium hydroxide, and then diluted with ion exchanged water to yield 10% homogeneous aqueous solution of the polymer. The polymer solution (600 g) is mixed with carbon black (100 g) and ion exchanged water (300 g). After the mixture is mechanically stirred for a predetermined time, undispersed components including course particles are removed by centrifugation to yield a black dispersion liquid. The pigment content in the resulting black dispersion liquid is 10% by mass.

For preparing the black ink used in the present embodiment, the following materials in predetermined amounts are added to the black dispersion liquid. After the materials are sufficiently stirred and mixed, the mixture is subjected to pressure filtration through a microfilter of 2.5 μm in pore size (manufactured by Fujifilm Corporation), and the pigment content is adjusted to 5%.

Black dispersion liquid: 50 parts

FSO-100 (produced by Du Pont): 0.05 part

Glycerin: 10 parts

Triethylene glycol: 10 parts

Acetylene glycol EO adduct (produced by Kawaken Fine Chemicals): 0.5 part

Ion exchanged water: 29.45 parts

Preparation of Cyan Ink

First, an AB block copolymer having an acid value of 250 and a number average molecular weight of 3000 is produced from benzyl acrylate and methacrylic acid in a conventional process. The block copolymer is neutralized with an aqueous solution of potassium hydroxide and then diluted with ion exchanged water to yield a 50% homogeneous aqueous solution of the polymer. The polymer solution (200 g) is mixed with C.I. Pigment Blue 15:3 (100 g) and ion exchanged water (700 g). After the mixture is mechanically stirred for a predetermined time, undispersed components including course particles are removed by centrifugation to yield a cyan dispersion liquid. The pigment content in the resulting cyan dispersion liquid is 10% by mass. C.I. Pigment Blue 15:3 is expressed by the following chemical formula (1):

(1)

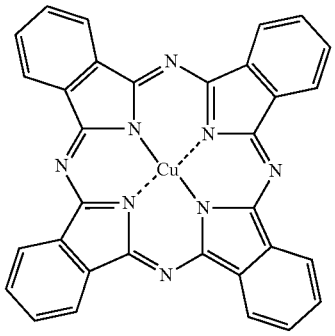

For preparing the cyan ink used in the present embodiment, the following materials in predetermined amounts are added to the cyan dispersion liquid. After the materials are sufficiently stirred and mixed, the mixture is subjected to pressure filtration through a microfilter of 2.5 μm in pore size (manufactured by Fujifilm Corporation), and the pigment content is adjusted to 2%.

Cyan dispersion liquid: 20 parts

FSO-100 (produced by Du Pont): 0.05 part

Glycerin: 10 parts

Diethylene glycol: 10 parts

Acetylene glycol EO adduct (produced by Kawaken Fine Chemicals): 0.5 part

Ion exchanged water: 59.45 parts

Preparation of Magenta Ink

First, an AB block copolymer having an acid value of 300 and a number average molecular weight of 2500 is produced from benzyl acrylate and methacrylic acid in a conventional process. The block copolymer is neutralized with an aqueous solution of potassium hydroxide and then diluted with ion exchanged water to yield a 50% by mass homogeneous aqueous solution of the polymer. The polymer solution (100 g) is mixed with C.I. Pigment Red 122 (100 g) and ion exchanged water (800 g). After the mixture is mechanically stirred for a predetermined time, undispersed components including course particles are removed by centrifugation to yield a magenta dispersion liquid. The pigment content in the resulting magenta dispersion liquid is 10% by mass. C.I. Pigment Red 122 is expressed by the following chemical formula (2):

(2)

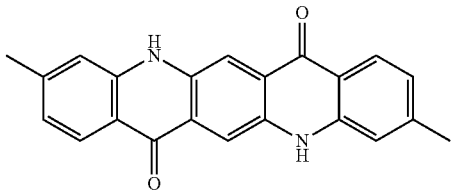

For preparing the magenta ink used in the present embodiment, the following materials in predetermined amounts are added to the magenta dispersion liquid. After the materials are sufficiently stirred and mixed, the mixture is subjected to pressure filtration through a microfilter of 2.5 μm in pore size (manufactured by Fujifilm Corporation), and the pigment content is adjusted to 4%.

Magenta dispersion liquid: 40 parts

FSO-100 (produced by Du Pont): 0.05 part

Glycerin: 10 parts

Diethylene glycol: 10 parts

Acetylene glycol EO adduct (produced by Kawaken Fine Chemicals): 0.5 part

Ion exchanged water: 39.45 parts

Preparation of Yellow Ink

First, an anionic polymer P-1 [styrene/butyl acrylate/acrylic acid copolymer (polymerization ratio: 30/40/30, acid value: 202, weight average molecular weight: 6500)] is neutralized with an aqueous solution of potassium hydroxide, and then diluted with ion exchanged water to yield a 10% by mass homogeneous aqueous solution of the polymer. The polymer solution (300 g) is mixed with C.I. Pigment Yellow 74 (100 g) and ion exchanged water (600 g). After the mixture is mechanically stirred for a predetermined time, undispersed components including course particles are removed by centrifugation to yield a yellow dispersion liquid. The pigment content in the resulting yellow dispersion liquid is 10% by mass. C.I. Pigment Yellow 74 is expressed by the following chemical formula (3):

(3)

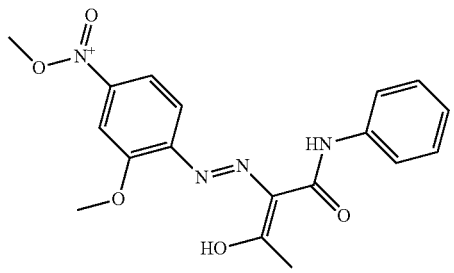

For preparing the yellow ink used in the present embodiment, the following materials are mixed and sufficiently stirred to be dissolved or dispersed. The mixture is then subjected to pressure filtration through a microfilter of 1.0 μm in pore size (manufactured by Fujifilm Corporation), and the pigment content is adjusted to 4%.

Yellow dispersion liquid: 40 parts

FSO-100 (produced by Du Pont): 0.025 part

Glycerin: 9 parts

Ethylene glycol: 10 parts

Acetylene glycol EO adduct (produced by Kawaken Fine Chemicals): 1 part

Ion exchanged water: 39.975 parts

If an ink less capable of or incapable of permeating a printing medium and having a high surface tension in liquid phase is used, ink droplets having landed on the surface of the printing medium is fixed in an aggregate state without spreading. Consequently, the quality of the resulting image is degraded. In particular, when an ink having a surface tension larger than 30 mN/m is applied onto a less permeable printing medium, the image quality of the resulting image is significantly degraded. Accordingly, the surface tensions of the inks are desirably 30 mN/m or less. In order to bring as close as possible the ejection properties of different inks ejected from ejection openings, such as the amount of ejected ink and ejection speed, and the permeation abilities of the inks on the printing medium, it is desirable that the surface tensions of the inks are brought as close as possible. Accordingly, the surface tensions, at the same temperature, of the inks used in the present embodiment are adjusted in the range of 25 mN/m to 26 mN/m.

The surface tensions in liquid phase of the inks mentioned herein are values measured with Bubble Pressure Tensiometer (product name) manufactured by KRUSS. However any other measuring instrument may be used as long as the surface tension of inks in liquid phase can be measured.

Although the inks used in the present embodiment have substantially the same surface tension in liquid phase as described above, the ink layers made of each ink applied to a printing medium have different critical surface tensions. These critical surface tensions vary depending on various parameters, such as the amount of the fluorocarbon surfactant in the ink, and the affinity of the surfactant with the pigment or polymer in the ink.

The printing medium used in the present embodiment will now be described in detail. As described above, as the ability of an ink to permeate a printing medium decreases, the ink more easily forms an ink layer on the surface of the printing medium. Accordingly, the advantage of the present disclosure becomes more apparent when the printing medium is less permeable to the ink.

Coated paper, which is produced by coating plain paper with, for example, white pigment, is one of such less permeable printing media.

In the present embodiment, OK Top Coat+ (manufactured by Oji Paper, basis weight: 157.0 g/m$^2$), which is one of the coated papers, is used as the printing medium 3.

In the present embodiment, the permeability of the printing medium to an ink can be evaluated by various techniques. One example of the techniques will now be described below in which the permeabilities of printing media are evaluated by Bristow's Method specified in Standard No. 51 of JAPAN TAPPI, "Test Method for Liquid Absorption of Paper and Paperboard" (in Japanese).

A predetermined amount of an ink is poured into a container having an aperture slit having a predetermined size, and a printing medium formed into a rectangular shape and wound around a disk is brought into contact with the ink through the slit. Thus the ink is transferred to the printing medium and forms an ink band. The area (or length) of this ink band is measured.

From the measured area of the ink band, the amount per unit area (mL·m$^{-2}$) of ink transferred for one second is calculated.

The amount of ink transferred to a normal coated printing paper for one second, measured by Bristow's Method, was 20 mL·m$^{-2}$ or less, and, particularly, that of OK Top Coat+ was slightly lower than 10 mL·m$^{-2}$. The printing method of the present embodiment can be suitable for printing media less permeable to ink, such as coated printing paper.

For many of plain papers, the amount of ink transferred for one second, measured by Bristow's method, is 30 mL·m$^{-2}$ or more. Thus plain paper is generally permeable to ink. For some of plain papers, however, the amount of ink transferred for one second, measured by Bristow's method, is less than 20 mL·m$^{-2}$. These printing media are less permeable to ink, in spite of plain paper. Printing media to which the present embodiment can be applied effectively are not limited to coated printing paper, as long as they are permeable to ink.

Also, it goes without saying that the present embodiment can be applied to printing media impermeable to ink, such as a polyethylene sheet.

In the present embodiment, images are formed by multipass printing. The multipass printing technique will now be described in detail.

Figure 6:
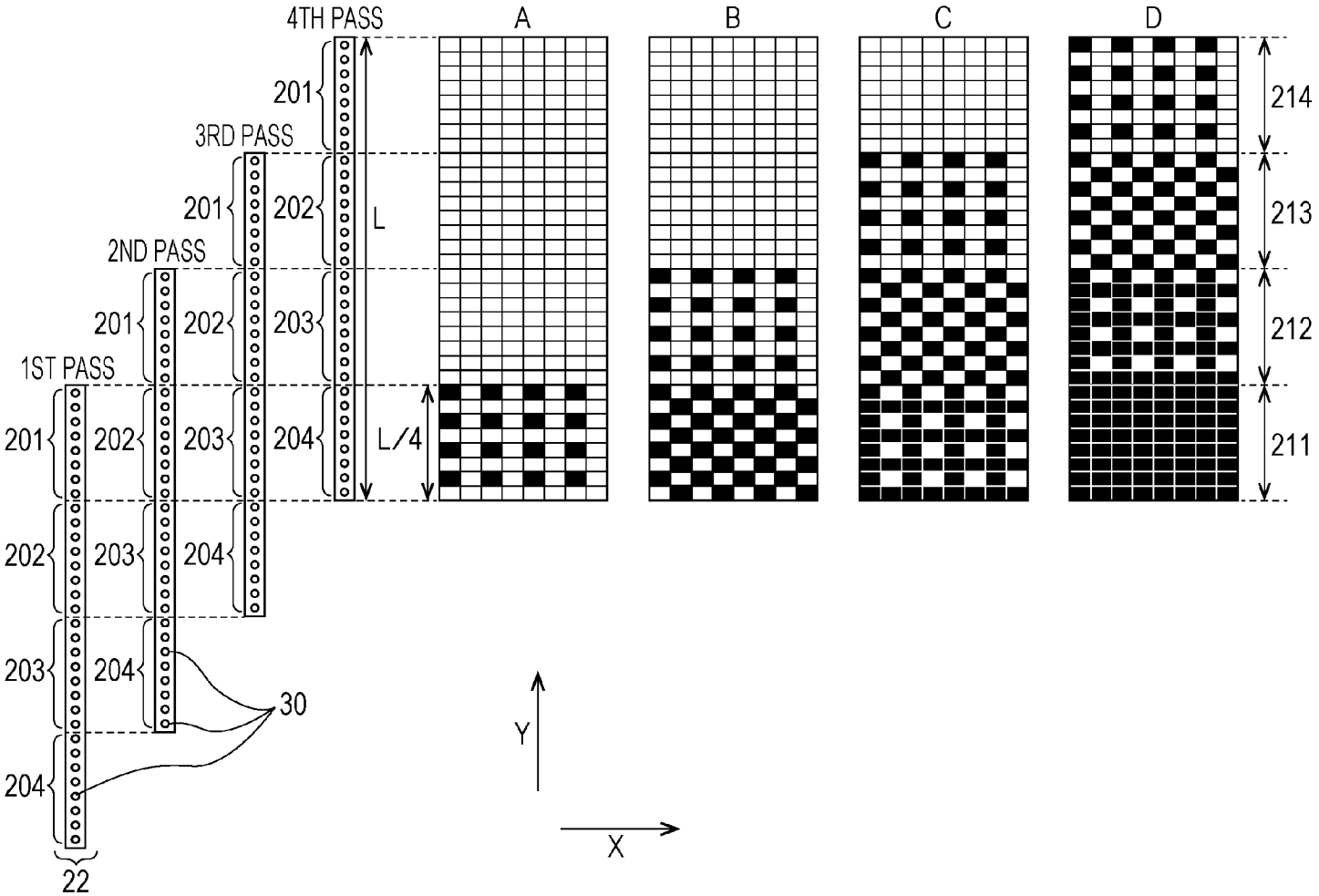
FIG. 6 is a representation of multipass printing method used in an embodiment of this application.
Figure 7A:
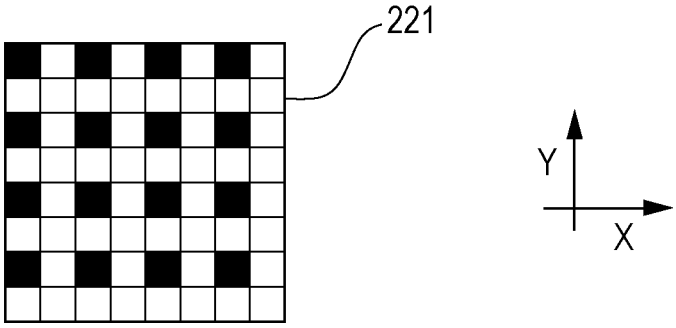
FIGS. 7A to 7D are schematic views of mask patterns used for general multipass printing.
Figure 7B:
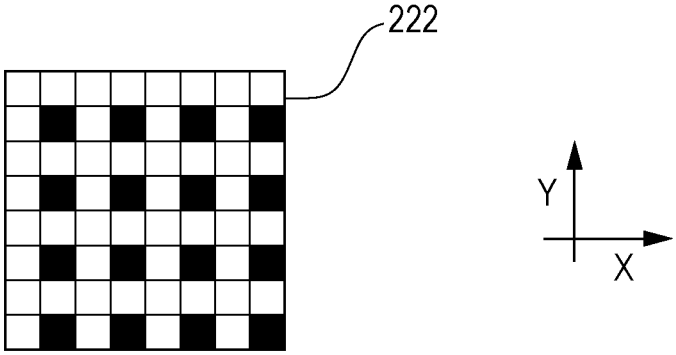
Figure 7C:
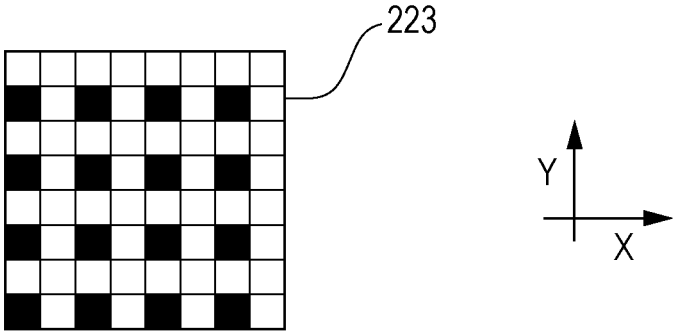
Figure 7D:
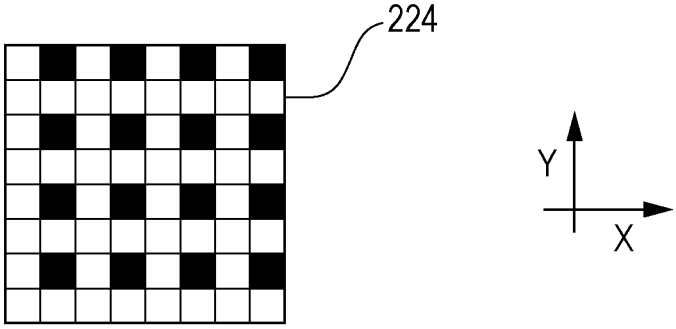

FIG. 6 is a representation of a multipass printing technique for printing an image within unit regions of a printing medium by four print scanning operations.

FIGS. 7A to 7D are representations of mask patters used for each of the four print scanning operations.

Ejection openings 30 of an ejection opening line 22 through which an ink is ejected are divided into four printing groups 201, 202, 203 and 204 in the sub scanning direction.

Each of the mask patterns 221, 222, 223 and 224 includes an arrangement of printable pixels and non-printable pixels. In FIGS. 7A to 7D, black solid portions indicate the printable pixels, and blank portions indicate the non-printable pixels. If input image data for the printable pixels represent ejection of an ink, the image data are converted into printing data for actually ejecting the ink. For the non-printable pixels, even if input image data represent ejection of an ink, the image data are converted into printing data for not ejecting ink.

The printable pixels of the mask patterns 221, 222, 223 and 224 lie at positions different among the mask patterns, but complementary to each other.

The formation of a solid image on a printing medium will be described below by way of example. In the first print scanning operation, printing group 201 ejects an ink onto region 211 of the printing medium 3 according to mask pattern 221. The ink is thus applied to the positions indicated in A shown in FIG. 6.

Subsequently, the printing medium 3 is conveyed by a length L/4 in the Y direction relative to the printing head 7.

Then, the second print scanning operation is performed. In the second print scanning operation, printing group 202 ejects the ink onto region 211 of the printing medium 3 according to mask pattern 222, and printing group 201 ejects the ink onto region 212 according to mask pattern 221. As the result of the second print scanning operation, an image shown in B of FIG. 6 is formed on the printing medium 3.

Thus the relative movement between the print scanning operation of the printing head 7 and the conveyance of the printing medium 3 is sequentially repeated. When the fourth print scanning operation has been made, application of the ink is completed for all of the pixel areas, corresponding to pixels, in region 211 of the printing medium 3, as shown in D of FIG. 6, thus forming a solid image.

In the following description, the pixel areas of the printing medium, corresponding to pixels, may refer to simply "the pixel areas".

Figure 8:
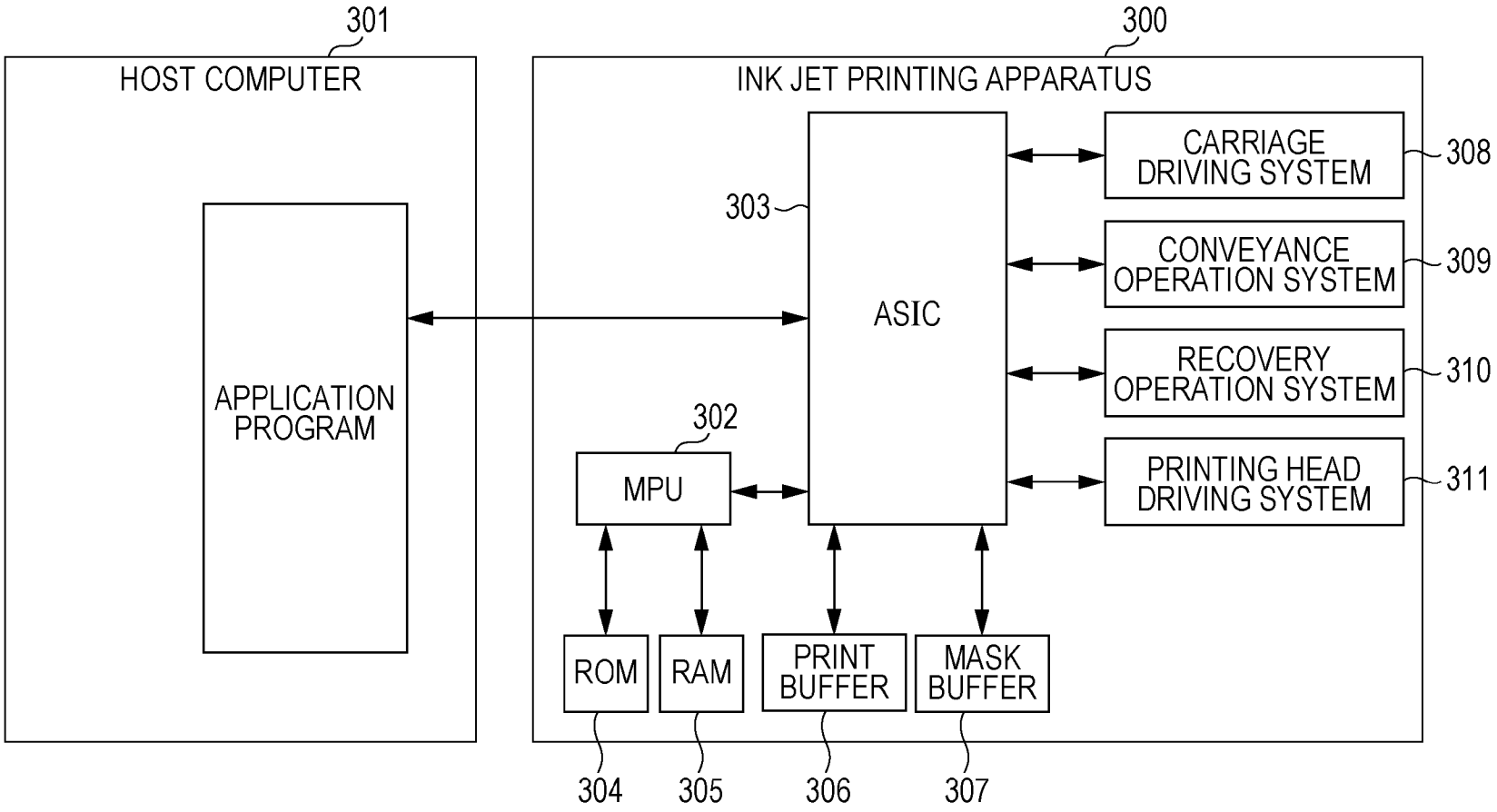
FIG. 8 is a block diagram of the structure of a print control system according to an embodiment of the invention.

FIG. 8 is a schematic block diagram illustrating the structure of a print control system used in the present embodiment.

A host computer 301, which is an image input section, transmits RGB multi-valued image data from a storage medium, such as a hard disk, to an image processing section in an ink jet printing apparatus 300.

The image processing section includes a microprocessor unit (MPU) 302 and an application-specific integrated circuit (ASIC) 303, which will be described later. The image processing section may also receive multi-valued image data from external image input devices connected to the host computer 301, such as a scanner and a digital camera. The image processing section processes the multi-valued image data input thereto to convert the data into binary image data, as will be described later. Thus, binary data are produced which are printing data for ejecting a plurality of inks from the printing head 7.

The ink jet printing apparatus 300, which is an image output section, applies inks onto a printing medium 3 according to the binary image data produced in the image processing section, thus printing an image on the printing medium 3. The ink jet printing apparatus 300 is controlled by MPU 302 according to an application program stored in a ROM 304. A RAM 305 functions as a work area of the MPU 302 and a temporary data storage area. The MPU 302 controls, via the ASIC 30, a driving system 308 of the carriage 6, a conveyance operation system 309 for the printing medium 3, a recovery operation system 310 for the printing head 7, and a driving system 311 of the printing head 7.

A print buffer 306 receives printing data that has been converted into a form that can be transmitted to the printing head 7 and temporarily stores the printing data.

A mask buffer 307 temporarily stores mask patterns that will be used when the printing data are transmitted to the printing head 7. A plurality of mask patterns used for multi-pass printing are prepared in the ROM 304, and mask patterns applicable to actual printing operation are read from the ROM 304 and stored in the mask buffer 307.

While the present embodiment describes the case where the ink jet printing apparatus 300 includes an image processing section, the host computer 301 may include the image processing section.

Evaluation of Wettability

In the present embodiment, the wettability of an ink on an ink layer is evaluated by measuring the contact angle of a droplet of the ink on the ink layer.

Contact angles of ink droplets in a combination of inks are measured with Drop Master (trade name, manufactured by Kyowa Interface Science). Any other instrument may be used as long as it can measure contact angles of pigment inks.

In the present embodiment, the surface of a region of a printing medium 3 where an ink is fixed and dried in all the pixels thereof (hereinafter referred to as solid region) is considered to be a solid surface. Onto this solid region, a droplet (about 4.5 ng) of another ink is ejected, and the angle between the surface of the solid region and the tangent to the droplet at the contact point with the solid surface is defined as the contact angle of the ink droplet with the ink layer.

The amount of one droplet for measuring the contact angle in the present embodiment is larger than that ejected from the printing head 7 of the present embodiment. Variation of the amount of ink applied varies the weight, evaporation speed, permeation speed or the like of the ink droplet. Accordingly, the present inventors dynamically measured contact angles for a plurality of droplets ejected with different weights and examined the relationship between the contact angle measured with a measuring instrument and the degree of wetting and spreading of a dot actually printed with one droplet. Thus the inventors found that the contact angle of an ink in the early stage of dropping is close to the contact angle of the ink before being affected by evaporation or permeation of the ink, independently of the amount of droplet dropped from the measuring instrument, and has close connection with the wetting and spreading of droplets of ejected ink. In the present embodiment, accordingly, the contact angles of ink droplets are each measured as immediately as 100 ms after being dropped.

Figure 9A:
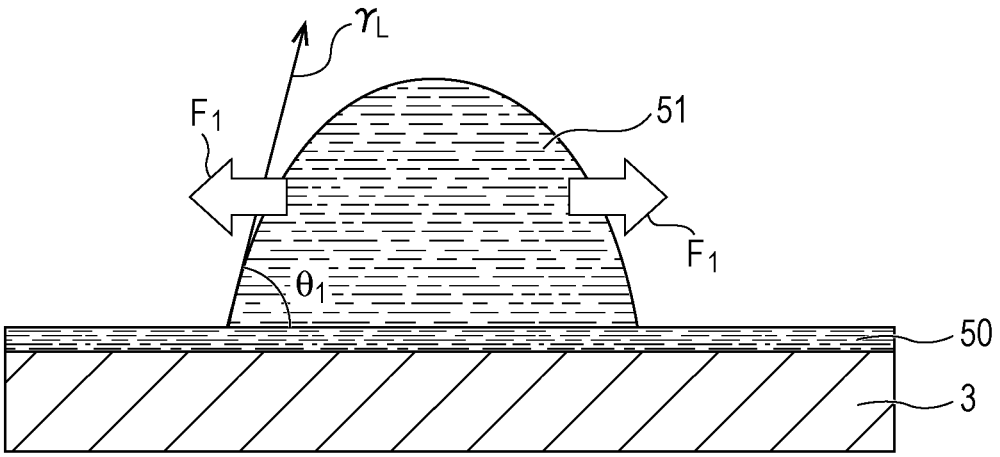
FIGS. 9A and 9B are schematic views of the states of printing media onto which inks having different contact angles have been ejected.
Figure 9B:
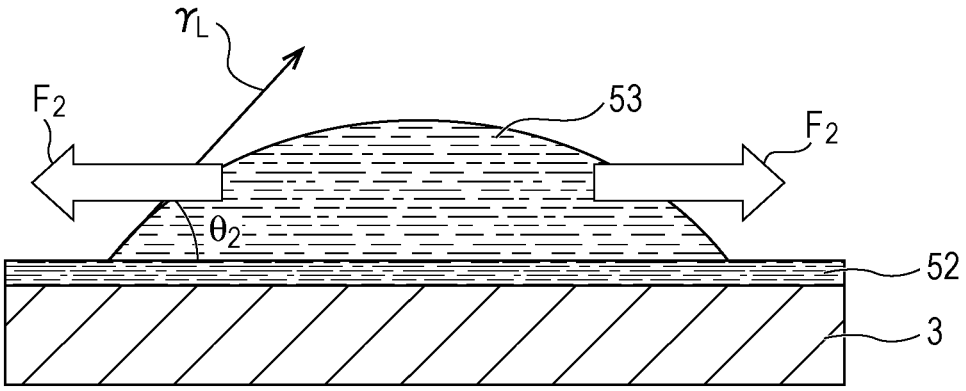

Referring to FIGS. 9A and 9B, evaluations will be described for the contact angle of an ink droplet with an ink layer, measured according to the method described above, and for the diameter and graininess of a dot formed after the ink droplet has been fixed.

FIGS. 9A and 9B illustrate the difference in wettability between pigment inks having different contact angles in their liquid states.

FIG. 9A shows a state of a droplet 51 of a magenta ink on the surface of an ink layer 50 made of a yellow ink on a printing medium 3. FIG. 9B shows a state of a droplet 53 of the yellow ink on the surface of an ink layer 52 made of the magenta ink on the printing medium 3.

The contact angle $\theta_1$ of the magenta ink droplet 51 with the yellow ink layer 50 is 36 degrees, and the contact angle $\theta_2$ of the yellow ink droplet 53 with the magenta ink layer 52 is 27 degrees. Even though the yellow ink and the magenta ink have substantially the same surface tension in liquid phase, the critical surface tension of the magenta ink layer 52 is larger than the critical surface tension of the yellow ink layer 50. The difference in contact angle between the two inks probably depends on how the inks are applied.

In the case of FIG. 9A, where the yellow ink and the magenta ink are applied in that order onto a printing medium, the contact angle $\theta_1$ of the magenta ink droplet 51 on the yellow ink layer 50 is larger, and accordingly, force $F_1$ is reduced which acts on the magenta ink droplet 51 in the directions parallel to the printing medium 3, in the directions in which the droplet spreads. Consequently, beading becomes liable to occur.

On the other hand, in the case of FIG. 9B, where the magenta ink and the yellow ink are applied in that order onto the printing medium, the contact angle $\theta_2$ of the yellow ink droplet 53 on the magenta ink layer 52 is smaller than the contact angle $\theta_1$, and accordingly, force $F_2$ acting on the yellow ink droplet 53 becomes larger than force $F_1$ acting on the magenta ink droplet 51. Consequently, even though yellow ink droplets 53 are landed at positions adjacent to each other in one print scanning operation, the droplets tend to stabilize in a spreading state.

Figure 10A:
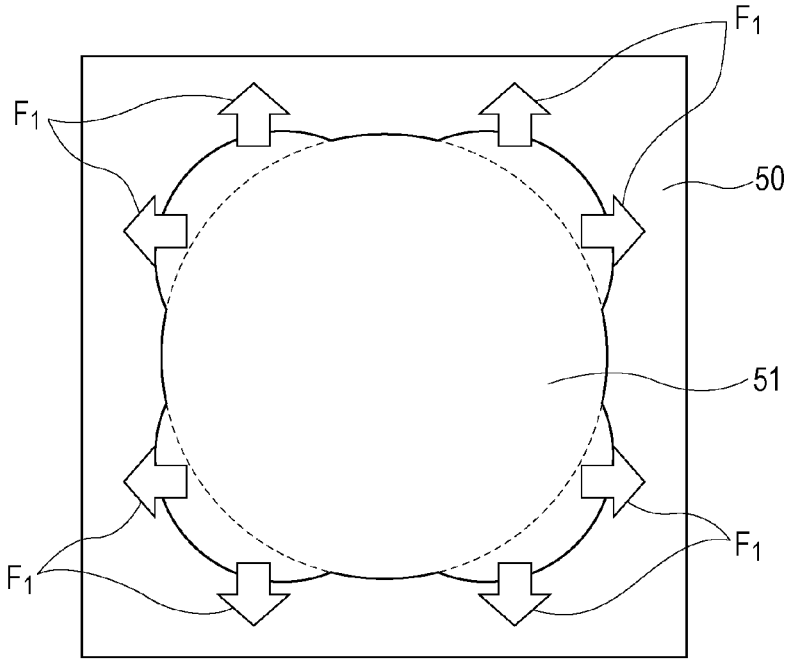
FIGS. 10A and 10B are representations of the comparison of beadings different in application order of inks.
Figure 10B:
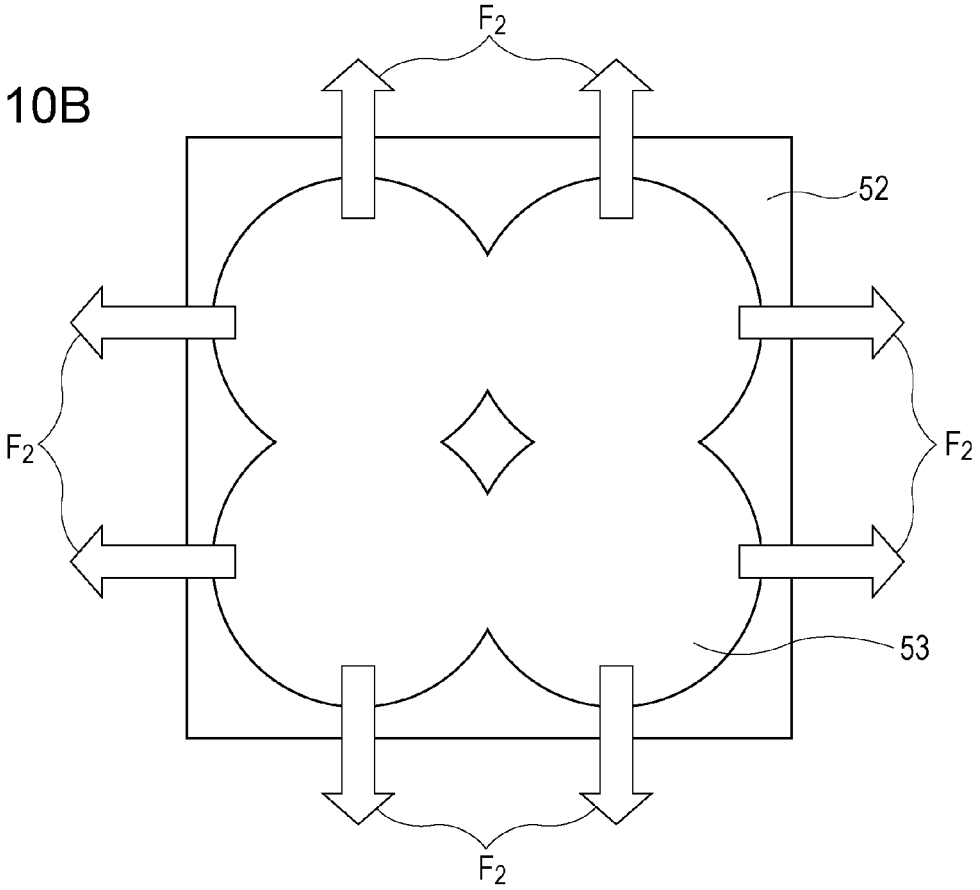

FIGS. 10A and 10B show the surfaces of the printing medium 3 on which a plurality of ink droplets have landed at positions adjacent to each other in one print scanning operation. FIG. 10A shows the same case as FIG. 9A, where the yellow ink and the magenta ink are applied in that order, and FIG. 10B shows the same case as FIG. 9B, where the magenta ink and the yellow ink are applied in that order.

In the case of FIG. 10B, where the magenta ink and the yellow ink are applied in that order, force $F_2$ acting on the yellow ink droplet 53 is larger than force $F_1$ acting on the magenta ink droplet 51 in the case of FIG. 10A, where the yellow ink and the magenta ink are applied in that order. Thus, beading is unlikely to occur.

Accordingly, in the present embodiment, degradation in image quality is suppressed by controlling the application order of the yellow ink and the magenta ink.

Figure 11:
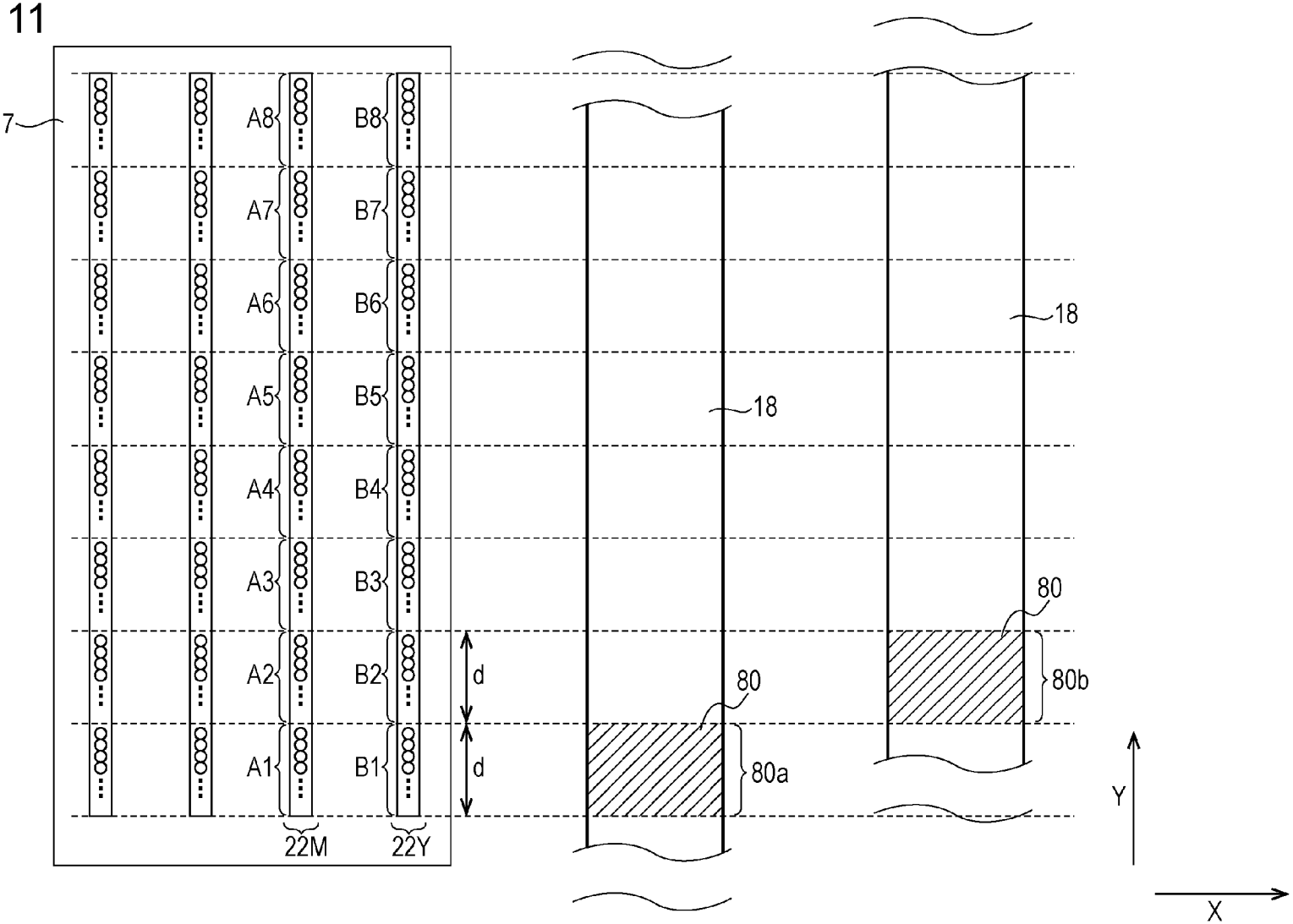
FIG. 11 is a representation of a multipass printing method used in an embodiment of the invention.

FIG. 11 is a representation of a multipass printing method applied to the present embodiment.

In the present embodiment, an image formation in a unit region 80 of a printing medium is completed by 8 print scanning operations. The printing head 7 used in the present embodiment includes ejection opening line 22M having ejection openings through which a magenta ink is ejected, and ejection opening line 22Y having ejection openings through which a yellow ink is ejected. In each ejection opening line, 1280 ejection openings are aligned and grouped into 8 printing groups: A1 to A8 or B1 to B8, each having a length d. Hence, each printing group has 160 ejection openings.

The length in the Y direction of one unit region 80 of the printing medium 3 is equal to the amount of relative movement in the Y direction in one print scanning operation of the printing head 7 and the printing medium 3, and also equal to the length d of each printing group of the ejection opening lines 22M and 22Y. The length of the unit region 80 in the X direction is equal to the length of the printing medium 3 in the X direction.

When the unit region 80, first, lies a position 80*a*, inks are ejected onto the unit region 80 from the ejection openings of printing group A1 in ejection opening line 22M and the ejection openings of printing group B1 in ejection opening line 22Y according to mask patterns described later while the printing head 7 is scanning in the X direction. Then, the printing medium 3 is conveyed by length d in the Y direction, so that the unit region 80 is moved to position 80*b*. After the conveyance, while the printing head 7 is scanning in the X direction, the inks are ejected from the ejection openings of printing group A2 in ejection opening line 22M and ejection openings of printing group B2 in ejection opening line 22Y onto the unit region 80 that has received inks ejected from the ejection openings of printing groups A1 and B1. The printing head 7 thus scans the unit region 80 on the printing medium 3 eight times in total to complete image formation while the printing medium 3 is conveyed by distance d between scanning operations.

Figure 12A:
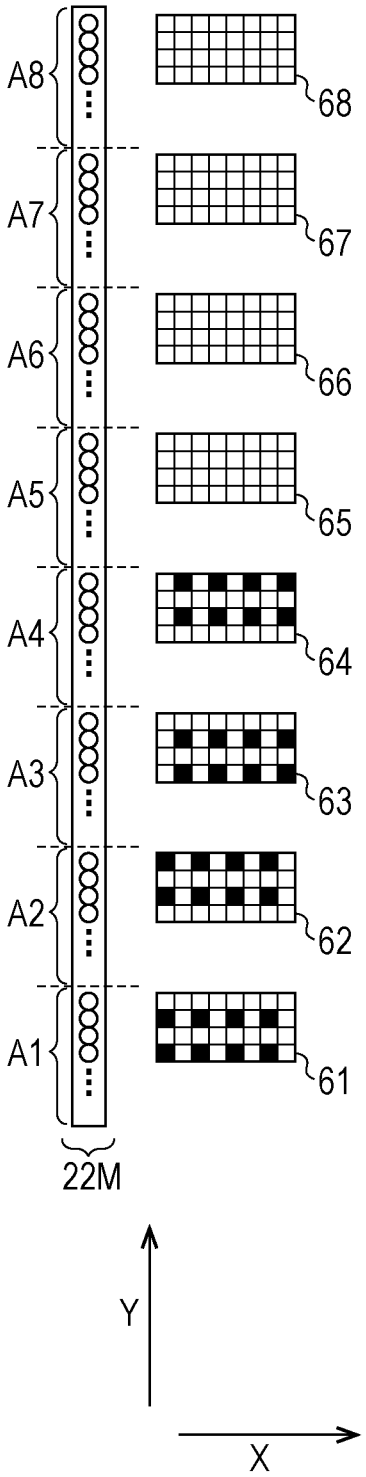
FIGS. 12A and 12B are schematic views of mask patterns used in an embodiment of the invention.
Figure 12B:
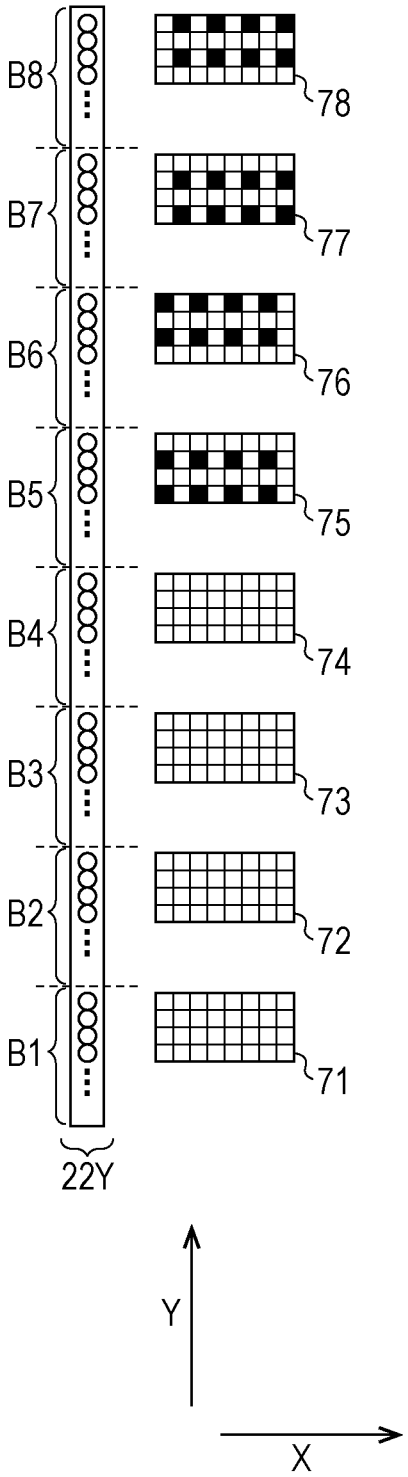

FIG. 12A shows mask patterns applied to line 22M of the ejection openings through which the magenta ink is ejected. FIG. 12B shows mask patterns applied to line 22Y of the ejection openings through which the yellow ink is ejected.

Printing groups A1 to A8 of magenta ink line 22M use mask patterns 61 to 68, respectively.

In each of mask patterns 61, 62, 63 and 64 corresponding to printing groups A1, A2, A3 and A4, respectively, printable pixels are assigned to 25% of all the pixels. The printable pixels of the mask patterns 61, 62, 63 and 64 lie at positions different among the mask patterns, but complementary to each other.

On the other hand, in each of mask patterns 65, 66, 67 and 68 corresponding to printing groups A5, A6, A7 and A8, respectively, printable pixels are not arranged.

Using these mask patterns, the magenta ink is ejected in the first half of the print scanning operations, that is, in the first to fourth print scanning operations, onto the unit region by 25% of all the pixels for each print scanning operation, but is not ejected in the second half, or the fifth to eighth, of the scanning operations. Thus, the magenta ink is applied to all the positions to be applied in the unit region by the first to fourth scanning operations.

Printing groups B1 to B8 of yellow ink line 22Y uses mask patterns 71 to 78, respectively.

Contrary to the case of the printing groups in magenta ink line 22M, printable pixels are not arranged in mask patterns 71, 72, 73 and 74 corresponding to printing groups B1, B2, B3 and B4.

Printable pixels are assigned to 25% of all the pixels in the unit region in each of mask patterns 75, 76, 77 and 78 corresponding to printing groups B5, B6, B7 and B8. The printable pixels in these mask patterns 75, 76, 77 and 78 lie at positions different among the mask patterns, but complementary to each other. More specifically, mask pattern 75 is the same as mask pattern 61; mask pattern 76, mask pattern 62; mask pattern 77, mask pattern 63; and mask pattern 78, mask pattern 64.

In the fifth to eighth print scanning operations for ejecting the yellow ink, the printable pixels arranged in the mask pattern used for a printing group corresponding to a scanning operation are located at the same positions as the printable pixels obtained from the logical sum of the printable pixels in the mask patterns used for the printing groups corresponding to the previous scanning operations for ejecting the magenta ink. More specifically, since the logical sum of the printable pixels in the mask patterns used for printing groups A1, A2, A3 and A4 represents all the pixels, the printable pixels in each mask pattern used for printing groups B5, B6, B7 and B8 must lie at the same positions obtained from the logical sum.

Therefore, the yellow ink is not ejected in the first-half print scanning operations, that is, in the first to fourth print scanning operations, but is ejected onto the unit region by 25% of all the pixels in each of the second-half print scanning operations, that is, in the fifth to eighth print scanning operations. Thus, the yellow ink is certainly ejected to the positions where the magenta ink has been applied in previous scanning operations, and after the eighth print scanning operation, all positions (100%) have been subjected to the application of the yellow ink.

In the embodiment shown in FIGS. 12A and 12B, the magenta ink can be ejected only in the first to fourth operations of 8 print scanning operations performed on the unit region of the printing medium, and then the yellow ink is ejected only in the fifth to eighth operations.

Figure 13:
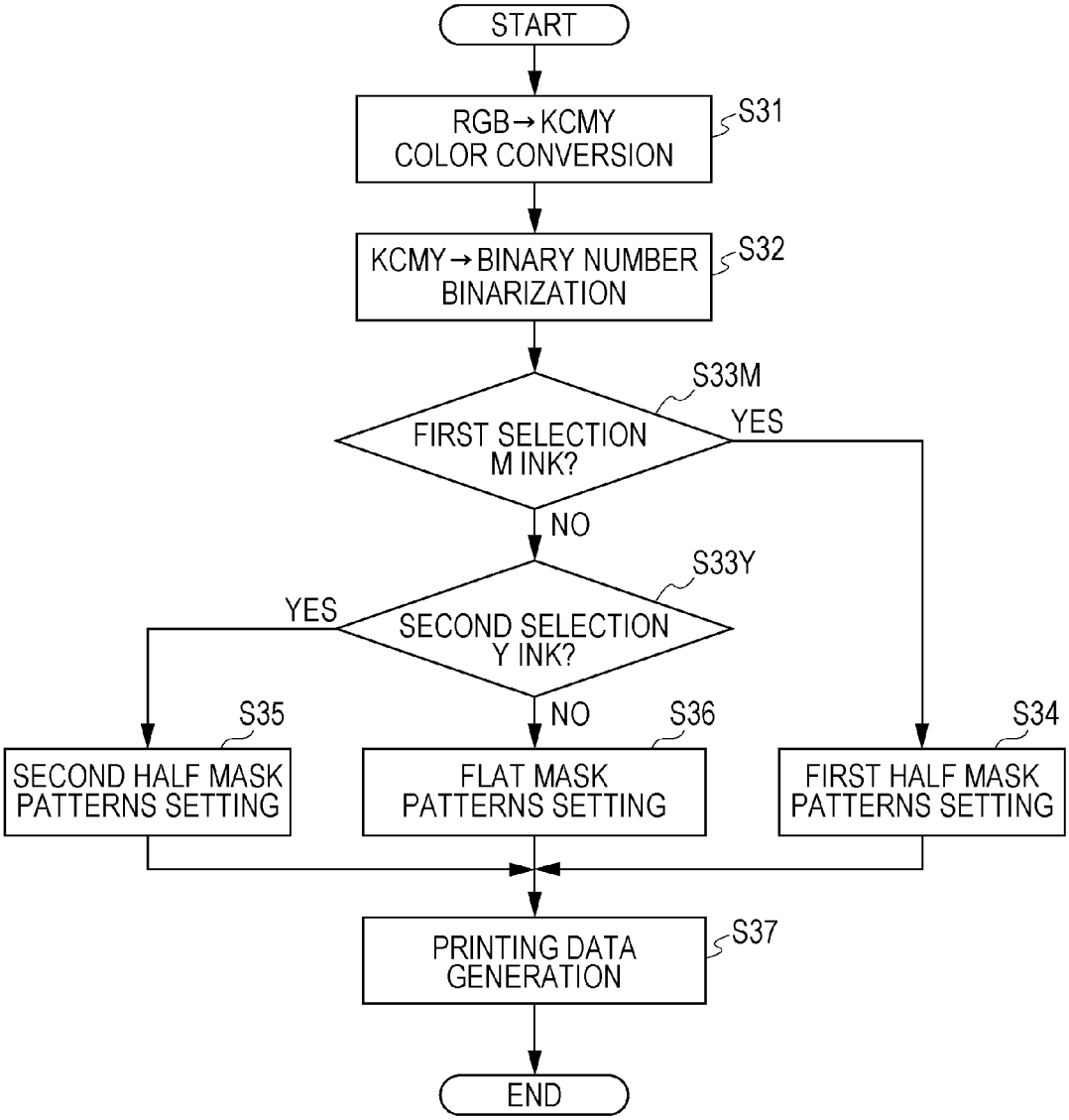
FIG. 13 is a block diagram of a data processing process in an embodiment of the invention.

FIG. 13 is a block diagram illustrating a process for processing an image in an image processing section according to the present embodiment.

RGB multi-valued image data input from the host computer 301, which is an image input section, are converted by color conversion S31 into CMYK multi-valued image data to be used for printing.

Subsequently, the CMYK multi-valued image data converted by color conversion are each developed by binarization S32 to binary image data according to the corresponding pattern stored. This binarization produces binary image data for ejecting a cyan ink, a magenta ink, a yellow ink and a black ink.

In first selection S33M, binary image data for ejecting the magenta ink is selected from all the binary data produced by the binarization S32. The selected binary data for ejecting the magenta ink is transmitted to the operation for first half mask pattern setting S34, and thus the above-described mask patterns are assigned.

In second selection S33Y, binary image data for ejecting the yellow ink is selected from the binary image data not selected in the first selection and is transmitted to the operation for second half mask pattern setting S35. In the second half mask pattern setting S35, the above-described mask patterns are assigned to the transmitted data for ejecting the yellow ink.

Binary image data for ejecting the cyan and black inks, not selected in the first selection S33M or the second selection S33Y are transmitted to the operation for flat mask pattern setting S36. For these binary image data, flat patterns are assigned. The flat patterns each include printable pixels arranged in the same proportion for each of the 8 scanning operations.

In the operation for printing data generation S37, image data are processed using the mask patterns assigned to the binary image data in the first half mask pattern setting S34, the second half mask pattern setting S35 and the flat mask pattern setting S36. Thus, printing data distributed to a plurality of print scanning operations for each ink are generated.

Thus, the inks are ejected from the printing head 7 of the ink jet printing apparatus 300 to form an image according to the generated printing data.

In any print scanning operations in the embodiment described above, the yellow ink is ejected onto the surface of an ink layer made of the magenta ink previously fixed to a printing medium. Thus, beading does not easily occur on the printing medium, and accordingly, degradation in image quality can be reduced.

Second Embodiment

The first embodiment has described a case in which the magenta ink is ejected only in the first half of a plurality of print scanning operations, whereas the yellow ink is ejected only in the second half of the print scanning operations.

On the other hand, the second embodiment will describe a case in which the magenta ink and the yellow ink are simultaneously ejected in some of a plurality of print scanning operations. The description of the same operations as in the first embodiment will be omitted.

Figure 14A:
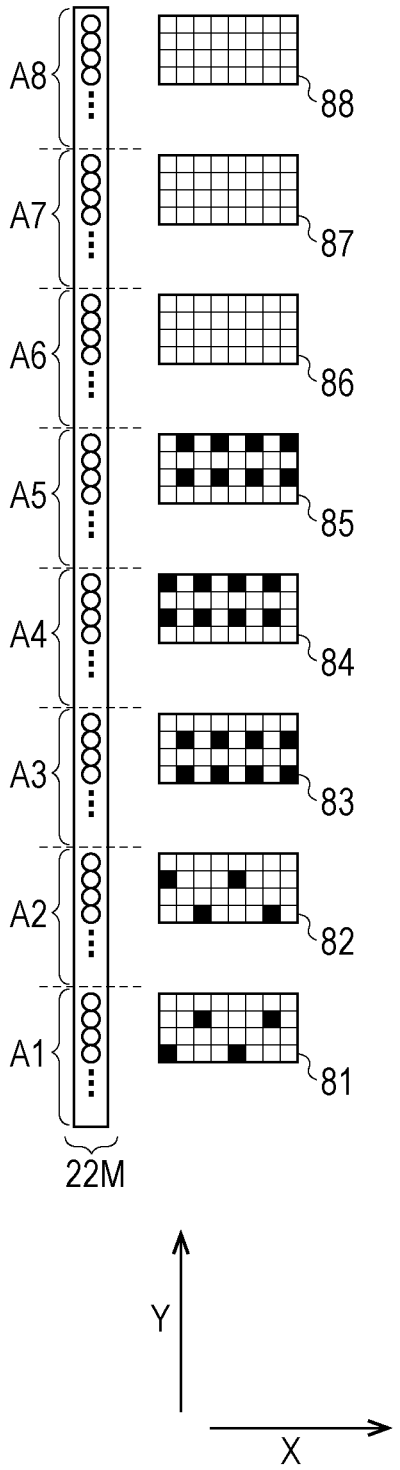
FIGS. 14A and 14B are schematic views of mask patterns used in an embodiment of the invention.
Figure 14B:
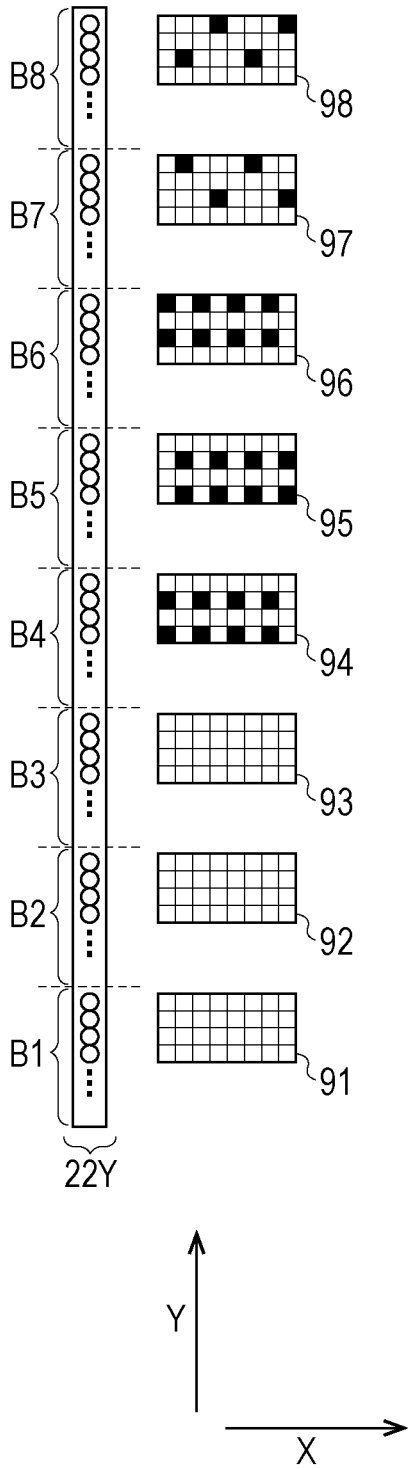

FIG. 14A shows mask patterns applied to line 22M of the ejection openings through which the magenta ink is ejected. FIG. 14B shows mask patterns applied to line 22Y of the ejection openings through which the yellow ink is ejected.

Ejection opening line 22M from printing group A1 used for the first scanning operation to printing group A8 used for the eighth scanning operation, from which the magenta ink is ejected, use mask patterns 81 to 88, respectively.

In this instance, printable pixels are arranged at 12.5% for each of mask patterns 81 and 82, and at 25% for each of mask patterns 83, 84 and 85. For mask patterns 86, 87 and 88, printable pixels are not assigned.

The printable pixels of mask patterns 81 to 85 lie at exclusive positions, but at complementary positions.

Printing groups B1 to A8 of line 22Y of ejection openings through which the yellow ink is ejected use mask patterns 91 to 98, respectively.

In this instance, printable pixels are arranged at a rate of 25% in each of mask patterns 94, 95 and 96, and at 12.5% in each of mask patterns 97 and 98. In mask patterns 91 and 92, printable pixels are not arranged.

The printable pixels of mask pattern 83 lie at the same position as those of mask pattern 95, and the printable pixels of mask pattern 84 lie at the same positions as those of mask pattern 96. Furthermore, the logical sum of the printable pixels in mask patterns 81 and 82 coincides with the printable pixels in mask pattern 94. Similarly, the logical sum of the printable pixels of mask patterns 97 and 98 coincides with the printable pixels of mask pattern 85.

In the present embodiment as well, in the fourth to eighth print scanning operations for ejecting the yellow ink, the printable pixels arranged in the mask pattern used for a printing group corresponding to a scanning operation are located at the same positions as the printable pixels obtained from the logical sum of the printable pixels in the mask patterns used for the printing groups corresponding to the previous scanning operations for ejecting the magenta ink. For example, the printable pixels in the mask pattern used for printing group B4 corresponding to the fourth print scanning operation for ejecting the yellow ink are located at the same positions as the printable pixels obtained from the logical sum of mask patterns 81 and 82 used for printing groups A1 and A2 corresponding to the first and second scanning operations for ejecting the magenta ink. More specifically, the printable pixels in mask pattern 94 corresponding to the fourth print scanning operation for ejecting the yellow ink are all located at the same positions as the printable pixels obtained from the logical sum of mask patterns 81, 82 and 83 corresponding to the scanning operations up to the third for ejecting the magenta ink.

Thus, in the first, second and third print scanning operations, only the magenta ink is ejected without ejecting the yellow ink. In the fourth print scanning operation, the yellow ink is applied to the positions on the printing medium to which the magenta ink has been applied in the first and second print scanning operations. In the fifth print scanning operation, the yellow ink is applied to the positions to which the magenta ink has been applied in the third scanning operation. Also, through the print scanning operations up to the fifth, the magenta ink is applied to all the pixels. Furthermore, in the sixth, seventh and eighth print scanning operations, the yellow ink is applied to the positions on the printing medium to which the magenta ink has been applied, whereas the magenta ink is not ejected.

In the present embodiment, even the yellow ink and the magenta ink are simultaneously ejected in some of the print scanning operations, the magenta ink and the yellow ink can be applied in that order onto all the pixels on a printing medium, as in the first embodiment. Thus, degradation in image quality can be suppressed.

Furthermore, the second embodiment increases the number of print scanning operations for each ink more than the first embodiment, and can produce the effect of the multipass method accordingly.

Also, since the amount of ejection from printing groups A1 and B8 at ends of the ejection opening lines can be reduced, displacement of landing positions of ink droplets ejected through ejection openings at the ends, where the ink is liable to be affected by air flow accompanying the ejection of inks, can be reduced.

The above-described embodiments have described cases where an ink having the larger contact angle is ejected onto all the unit regions after an ink having the lower contact angle. It is however not necessary that an ink having a relatively larger contact angle is ejected onto all the unit regions later.

In the first and the second embodiment, a printing head in which the first and second ejection opening lines are arranged at positions corresponding to the Y direction is used in such a manner that a predetermined number of ejection openings at one end of the first ejection opening line (upstream end, in the embodiments) and a predetermined number of ejection openings at the other end of the second ejection opening line (downstream end, in the embodiments) are not used. However, the concept of the disclosure is not limited to the above-described embodiments and can be applied to various printing heads that can control the ejection order of inks. For example, a printing head in which the first and the second ejection opening line are staggered in the Y direction may be used so that all the ejection openings in the first and the second ejection opening line can be used.

Third Embodiment

The first and the second embodiment have described cases of controlling the ejection order of two inks of a plurality of inks, wherein beading resulting from the difference in wettability between the two inks affects printing to the largest extent.

In a third embodiment, the ejection order of three inks is controlled. The description of the same operations as in the first embodiment will be omitted.

FIG. 15 shows comparisons of contact angles, dot sizes in diameter, and graininess when one of two inks selected from four inks is applied to the surface of a layer made of the other ink on a printing medium.

The dot size is obtained by measuring the diameter of a dot formed after ink droplets have landed on a solid region on a printing medium 3 through a metallurgical microscope.

The graininess is evaluated by comparing the graininess of an image including solid images simultaneously printed with two inks without determining the ejection order, with the graininess of an image including a solid image printed with one of the two inks on a printing medium and then a solid image subsequently printed with the other ink.

As shown in FIG. 15, when the contact angle is small, the dot size increases; when the contact angle is large, the dot size decreases.

Furthermore, it is shown that graininess becomes worse as the difference in relative contact angle increases between two inks when the ejection order of the two inks is changed.

FIG. 15 suggests that, in the case of using the yellow ink, the degree of graininess can be reduced more when the yellow ink is applied onto layers made of any of the other inks.

In the case of using the black ink, graininess becomes significant when the black ink is applied onto layers made of any of the other inks. Accordingly, when the black ink of the four inks is first applied onto a printing medium, graininess can be reduced effectively.

For the ejection order of the cyan and magenta inks, either of the two inks can be first applied without varying the graininess.

In the present embodiment, accordingly, the ejection order of the inks are determined for each unit region on a printing medium according to these results so that the black ink, the cyan ink, the magenta ink and the yellow ink are ejected in that order onto the unit region.

Figure 16:
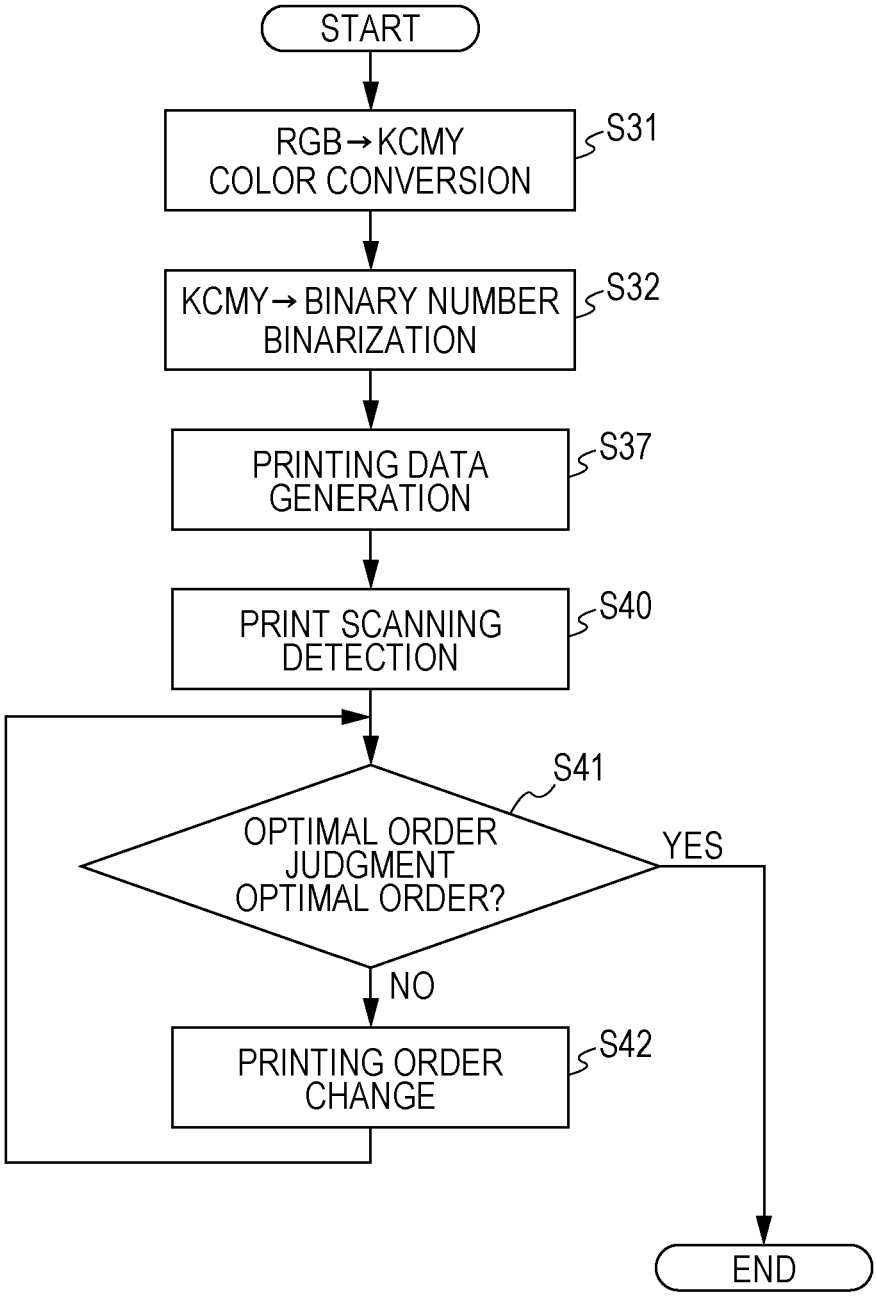
FIG. 16 is a block diagram of a data processing process in an embodiment of the invention.

FIG. 16 is a block diagram illustrating a process for processing an image in an image processing section according to an embodiment of the invention.

Multi-valued image data input from a host computer 301, which is an image input section, is processed in color conversion S31 and binarization S32 in the same manner as in the first embodiment.

Printing data corresponding to each of a plurality of print scanning operations are generated in printing data generation S37 by using a plurality of mask patterns for binary image data binarized in binarization S32 for ejecting the cyan ink, the magenta ink, the yellow ink and the black ink. The mask patterns can be set as needed.

Print scanning detection S40 detects the orders of print scanning operation, for each pixel, for ejecting each of the cyan ink, the magenta ink, the yellow ink and the black ink, according to the printing data generated in print data generation S37. Thus, the ejection order of the plurality of inks is determined for each pixel by this print scanning detection.

Optimal order judgment S41 judges for each pixel whether or not the ejection order of the plurality of inks is optimal, according to the data detected by print scanning detection S40 for print scanning operations for each ink and optimal ejection order. The optimal ejection order of the inks has previously been measured and stored in the ROM 304.

In the present embodiment, it is advantageous to eject the black ink, the cyan or magenta ink, and the yellow ink in that order.

If optimal order judgment S41 judges the ejection order to be optimal, the printing data is transmitted to the printing head without being processed.

If optimal order judgment S41 does not judge the ejection order to be optimal, the printing data is transmitted to printing order change S42.

In the printing order change S42, the printable pixels for the two inks whose ejection order has not been judged to be optimal are rearranged to optimize the ejection order. Then, the printing data are transmitted to the optimal order judgment S41 for confirmation that the printing order is optimal.

Thus, the ejection order of three or more inks can be optimized according to the relative magnitudes of the contact angles among the inks.

More specifically, in all the unit regions on a printing medium, an ink having a relatively small contact angle can be applied onto an ink layer made of an ink having a relatively large contact angle. Thus, graininess resulting from beading can be markedly reduced even if ink layers overlie one another.

Fourth Embodiment

The first to third embodiments have described techniques for controlling ejection order of a plurality of inks in a printing apparatus using a multipass printing method, which is the printing technique of performing a plurality of scanning operations on a unit region on a printing medium.

In a fourth embodiment, the ejection order of a plurality of inks is controlled using a plurality of printing heads for each of the inks. Each printing head has a length corresponding to the width of the printing medium so that printing is performed by one print scanning operation with relative movement of the printing medium and the printing heads.

Figure 17:
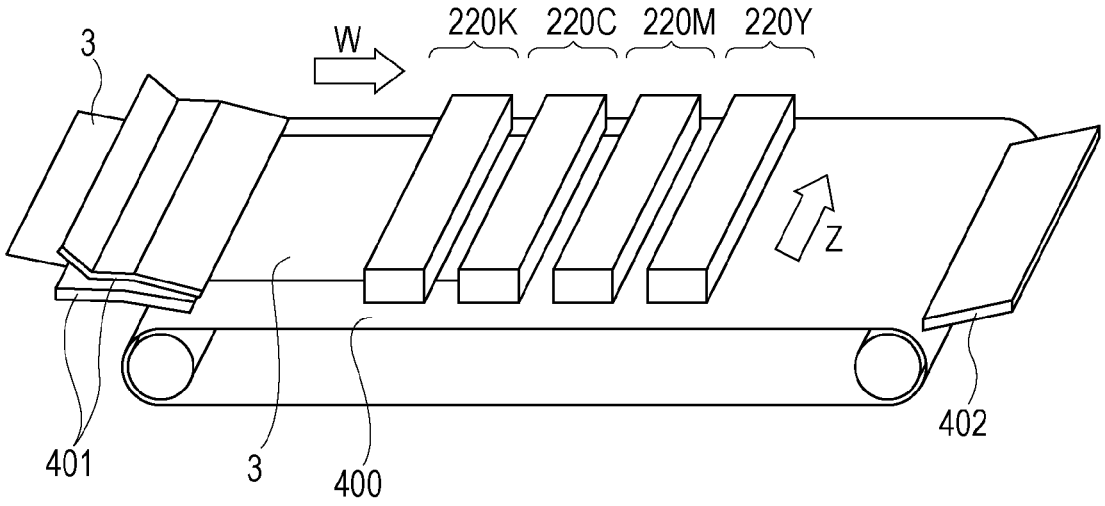
FIG. 17 is a perspective view of a printing apparatus according to an embodiment of the invention.

FIG. 17 is a perspective view of the internal structure of a printing apparatus according to the present embodiment. Four printing heads 220C, 220M, 220Y and 220K each have a predetermined number of ejection openings (not shown) through which a cyan ink, a magenta ink, a yellow ink or a black ink is ejected. The ejection openings are arranged in the Z direction. Each line of the ejection openings has a length more than or equal to the width in the Z direction of the printing medium 3 so that the printing medium 3 can be printed across the entire width thereof.

A conveying belt 400 conveys the printing medium 3, supported for rotation in the W direction intersecting the Z direction by a sheet feeding portion 401 and a sheet ejecting portion 402.

The printing medium 3 is fed by the sheet feeding portion 401 and conveyed in the W direction by the conveying belt 400.

In the present embodiment, printing heads 220K, 220C, 220M and 220Y are arranged in that order in the W direction.

The black ink, the cyan ink, the magenta ink and the yellow ink are applied in that order to the unit region on the printing medium.

In the present embodiment, even in the case of using a printing apparatus that performs one print scanning operation on each unit region of a printing medium for printing, the inks can be ejected in order suitable for the contact angles of the inks, so that graininess resulting from beading can be reduced.

In addition, image formation can be completed by only one print scanning operation, and printing time can be reduced accordingly.

While the present embodiment uses printing head having long ejection opening lines having a length in the Z direction corresponding to the width of the printing medium, printing heads having short ejection opening lines may be aligned in the Z direction to form a long line of ejection openings.

As described above, the printing apparatus of an embodiment of the invention enables inks to be ejected in such order that inks applied to a layer made of a previously applied ink have relatively smaller contact angles, as described above. Thus, degradation in image quality resulting from beading caused by difference in contact angle can be reduced.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In the above embodiments, inks containing a fluorocarbon surfactant are used. The inks used in embodiments of the invention are, however, not limited to this, as long as two inks are used which have a large difference in contact angle when their ejection order is changed. The difference in contact angle produced by changing the ejection order of inks increases when the two inks in liquid phase have substantially the same surface tension and can form layers having different critical surface tensions on a printing medium. This phenomenon can occur not only in use of inks containing a fluorocarbon surfactant, but also in use of inks containing, for example, a silicone surfactant.

Also, in the above-described embodiments, a coated paper less absorbent of ink is used as the printing medium. The printing medium is however not limited to less absorbent pater, and a nonabsorbent sheet, such as a polyvinyl chloride sheet, may be used effectively. Furthermore, the method for applying inks may be changed according to the type of printing medium or the printing mode (such as draft mode or high-definition mode). Referring now to FIG. 8, a user selects a printing mode on a user interface connected to a host computer 301, from a plurality of modes including an image printing mode for printing a photograph, a map, or the like, and a draft printing mode for printing letters and characters. The application program in the host computer 301 transmits mode information and a print job to the ink jet printing apparatus 300. An image processing section of the ink jet printing apparatus 300 sets a printing mode according to the transmitted mode information. Assume that the ink jet printing apparatus 300 sets the image printing mode for printing a photograph or the like. In this instance, a printing method of an embodiment is performed in such a manner that the number of pixel areas onto which inks are ejected in decreasing order of contact angle can be larger than the number of pixel areas onto which the inks are ejected in increasing order of contact angle. Consequently, the printed photograph has reduced graininess. In contrast, assume that the ink jet printing apparatus 300 determines to perform a draft printing mode. In this instance, printing is performed in such a manner that the number of pixel areas onto which inks are ejected in decreasing order of contact angle can be substantially the same as the number of pixels onto which the inks are ejected in increasing order of contact angle, without controlling the ejection order of the inks. This is because the image quality of letters and characters is not degraded even if the graininess is coarse, and accordingly, image processing can be simplified.

Although the above-described embodiments use mask patterns for distributing binary data for each scanning operation, any other technique may be applied, without limitation to mask patterns, as long as printing is performed for each pixel. For example, a distribution circuit in an image printing apparatus may sequentially distribute printing data for each pixel to a plurality of buffers corresponding to a plurality of print scanning operations, and it may be determined what scanning operation is applied to printing in each pixel. This distribution circuit can control when inks are ejected to each pixel (in terms of ejection order).

Embodiments of the invention can reduce the graininess and degradation in uniformity of printed images resulting from difference in wettability among inks, and thus can provide high-quality images.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-136148, filed Jun. 28, 2013, which is hereby incorporated by reference herein in its entirety.

What is claimed is:

1. A printing apparatus comprising:

a printing head capable of ejecting a first color ink containing a pigment and a second color ink containing a pigment and having a color different from the first color ink, the first color ink having a contact angle on a layer made of the second color ink larger than the contact angle of the second color ink on a layer made of the first color ink;

a scanning unit configured to cause the printing head to scan a printing medium in a scanning direction, the printing medium having a unit region including a plurality of pixel areas corresponding to pixels; and a controller configured to control the printing head so as to eject the first and the second color ink onto the pixel areas while the scanning unit causes the print head to scan the printing medium, and to control ejection of the first and the second color ink so that the number of pixel areas in the unit region onto which the second color ink is applied after the first color ink is larger than the number of pixel areas in the unit region onto which the first color ink is applied after the second color ink.

2. The printing apparatus according to claim 1, wherein the scanning unit enables the printing head to perform scanning operation a plurality of times on the unit region of the printing medium in the scanning direction, and the controller controls the ejection of the first and the second color ink so that the number of pixel areas in the unit region onto which the second color ink is ejected in the scanning operation performed after the scanning operation in which the first color ink is ejected thereto is larger than the number of pixel areas in the unit region onto which the first color ink is ejected in the scanning operation performed after the scanning operation in which the second color ink is ejected thereto.

3. The printing apparatus according to claim 1, wherein the controller controls the ejection of the first and the second color ink so that all the pixel areas in the unit region receive the second color ink after the first color ink.

4. The printing apparatus according to claim 1, wherein the scanning unit enables the printing head to perform scanning operation a plurality of times on the unit region of the printing medium in the scanning direction, and the controller controls the ejection of the first and the second color ink so that all the pixel areas in the unit region receive the second color ink in the scanning operation performed after the scanning operation in which the first color ink is ejected.

5. The printing apparatus according to claim 1, wherein the first color ink in liquid phase and the second color ink in liquid phase have substantially the same surface tension at the same temperature.

6. The printing apparatus according to claim 1, wherein the first color ink in liquid phase and the second color ink in liquid phase each have a surface tension of 30 mN/m or less.

7. The printing apparatus according to claim 1, wherein a layer made of the first color ink has a larger critical surface tension than a layer made of the second color ink.

8. The printing apparatus according to claim 1, wherein the printing head is further capable of ejecting a third color ink having a color different from the first and the second color ink and having a contact angle on a layer made of the second color ink smaller than the contact angle of the second color ink on a layer made of the third color ink, and the controller controls the ejection of the first, the second and the third color ink so that the number of pixel areas in the unit region onto which the third color ink is applied after the second color ink is larger than the number of pixel areas in the unit region onto which the second ink is applied after the third ink.

9. The printing apparatus according to claim 1, further comprising a conveying unit configured to convey the printing medium in a conveying direction intersecting the scanning direction between two successive scanning operations of the printing head, wherein the printing head includes a first line of a plurality of ejection openings through which the first color ink is ejected, and a second line of a plurality of ejection openings through which the second color ink is ejected, and the second line is disposed at a position shifted in the scanning direction from the position of the first line, downstream of the conveying direction from the first line.

10. The printing apparatus according to claim 1, further comprising a conveying unit configured to convey the printing medium in a conveying direction intersecting the scanning direction between two successive scanning operations of the printing head, wherein the printing head includes a first line of a plurality of ejection openings through which the first color ink is ejected, and a second line of a plurality of ejection openings through which the second color ink is ejected, and the first and the second line are disposed at different positions in the scanning direction, corresponding to the conveying direction, and wherein a predetermined number of ejection openings at the end of the first line downstream of the conveying direction and a predetermined number of ejection openings at the end of the second line upstream of the conveying direction are not used for printing.

11. The printing apparatus according to claim 1, wherein the printing head includes a first line of a plurality of ejection openings through which the first color ink is ejected, and a second line of a plurality of ejection openings through which the second color ink is ejected, and wherein the controller controls the ejection of the first and the second color ink by assigning mask patterns including printable pixels and non-printable pixels to image data, and the mask pattern applied to a predetermined number of ejection openings of the second line for a predetermined scanning operation is the same as the mask pattern applied to a predetermined number of ejection openings of the first line for a scanning operation performed after the predetermined scanning operation.

12. The printing apparatus according to claim 1, wherein the first color ink and the second color ink each contain a surfactant having a perfluoroalkyl group.

13. The printing apparatus according to claim 1, wherein a dot of the first color ink formed by being ejected in a predetermined amount onto a layer made of the second color ink on the printing medium has a smaller diameter than a dot of the second color ink formed by being ejected in the predetermined amount onto a layer made of the first color ink on the printing medium.

14. The printing apparatus according to claim 1, wherein the printing medium allows the first and the second color ink to be transferred thereto at a rate of 20 $mL \cdot m^{-2}$ or less for one second, the rate being measured by Bristow's Method.

15. An image processing apparatus that generates printing data determining ejection processing of a first color ink containing a pigment and a second color ink containing a pigment and having a color different from the first color ink so that the inks are ejected onto a plurality of pixel areas, corresponding to pixels, arranged in a unit region of a printing medium while a printing head configured to eject the first and the second color ink is performing scanning operation on the unit region in a scanning direction a plurality of times with relative scanning of the printing head and the printing medium, the printing data being assigned to each of the pixel areas, the image processing apparatus comprising:

a first binary data obtaining unit configured to obtain first data representing that the first color ink is ejected or not ejected onto the pixel areas in the unit region;

a second binary data obtaining unit configured to obtain second data representing that the second color ink is ejected or not ejected onto the pixel areas in the unit region; and a printing data generation unit configured to generate a plurality of printing data corresponding to the plurality of times of scanning operations by using the first and second binary data, the first binary data being related to a plurality of first mask patterns each including printable pixels and non-printable pixels, the second binary data being related to a plurality of second mask patterns each including printable pixels and non-printable pixels, wherein the first color ink has a contact angle on a layer made of the second color ink larger than the contact angle of the second color ink on a layer made of the first color ink, and wherein the printable pixels in the first and the second mask patterns are arranged so that the number of printable pixels of the second mask pattern for a predetermined scanning operation, located at the same positions as the printable pixels obtained from the logical sum of the printable pixels of the first mask patterns for the scanning operations performed before the predetermined scanning operation is larger than the number of printable pixels of the first mask pattern corresponding to the predetermined scanning operation, located at the same positions as the printable pixels obtained from the logical sum of the printable pixels in the second mask patterns for the scanning operations performed before the predetermined scanning operation.

16. The image processing apparatus according to claim 15, wherein the first color ink in liquid phase and the second color ink in liquid phase have substantially the same surface tension at the same temperature.

17. The image processing apparatus according to claim 15, wherein a layer made of the first color ink has a larger critical surface tension than a layer made of the second color ink.

18. The image processing apparatus according to claim 15, wherein the second mask patterns for the second scanning operation are the same as the first mask patterns for the first scanning operation.

19. The image processing apparatus according to claim 15, wherein the first color ink and the second color ink each contain a surfactant having a perfluoroalkyl group.

20. A printing method comprising:

ejecting a first color ink containing a pigment and a second color ink containing a pigment and having a color different from the first color ink onto a plurality of pixel areas, corresponding to pixels, arranged in a unit region of a printing medium from a printing head while scanning the printing head relative to the printing medium for scanning operation, wherein the first color ink has a contact angle on a layer made of the second color ink larger than the contact angle of the second color ink on a layer made of the first color ink, and wherein the first and the second color ink are ejected so that the number of pixel areas in the unit region onto which the second color ink is ejected after the first color ink is larger than the number of pixel areas in the unit region onto which the first color ink is ejected after the second color ink.

21. A storage medium comprising a program stored therein that operates a computer of a printing apparatus to perform the printing method as set forth in claim 20.

22. A print control apparatus comprising:

a printing head capable of ejecting a first color ink containing a pigment and a second color ink containing a pigment and having a color different from the first color ink, the first color ink having a contact angle on a layer made of the second color ink larger than the contact angle of the second color ink on a layer made of the first color ink;

a scanning unit configured to cause the printing head to scan a printing medium in a scanning direction, the printing medium having a unit region including a plurality of pixel areas corresponding to pixels; and a printing mode setting unit configured to set a first printing mode and a second printing mode different from the first printing mode; and an ejection controller configured to control ejection of the first and the second color ink so that the printing head ejects the first and the second color ink onto the pixel areas according to one of the first and the second printing mode while the scanning unit cause the printing head to scan, wherein when the printing mode setting unit sets the first printing mode, the ejection controller controls ejection of the first and the second color ink so that the number of pixel areas in the unit region onto which the second color ink is applied after the first color ink is larger than the number of pixel areas in the unit region onto which the first color ink is applied after the second color ink.

23. The print control apparatus according to claim 22, wherein when the printing mode setting unit sets the second printing mode, the ejection controller controls ejection of the first and the second color ink so that the number of pixel areas in the unit region onto which the second color ink is applied after the first color ink is substantially the same as the number of pixel areas in the unit region onto which the first color ink is applied after the second color ink.

24. The print control apparatus according to claim 23, wherein the first printing mode is used for printing graphics and the second printing mode is used for printing letters and characters.

* * * * *